United States Patent [19]

Eidschun et al.

[11] Patent Number: 4,483,271

[45] Date of Patent: Nov. 20, 1984

[54] CLOSED LOOP PROCESSING OF MATERIALS

[75] Inventors: Harry L. Eidschun, San Jose; Wilfred E. Montemayor, San Lorenzo, both of Calif.

[73] Assignee: FMC Corporation, Chicago, Ill.

[21] Appl. No.: 524,718

[22] Filed: Aug. 19, 1983

[51] Int. Cl.[3] ..... B05D 15/00

[52] U.S. Cl. ..... 118/698; 118/704; 118/302; 118/315; 118/320; 118/326; 427/421; 427/425

[58] Field of Search ..... 118/698, 704, 302, 315, 118/320, 326; 427/421, 425

[56] References Cited

U.S. PATENT DOCUMENTS

| | | | |
|---|---|---|---|
| 3,348,774 | 10/1967 | Wiggins | 118/704 X |
| 3,716,022 | 2/1973 | Szczepanski | 118/704 X |
| 3,952,699 | 4/1976 | Durr et al. | 118/320 X |

FOREIGN PATENT DOCUMENTS

| | | | |
|---|---|---|---|
| 6017 | 12/1979 | European Pat. Off. | 118/326 |

OTHER PUBLICATIONS

Technical Data Sheets of Amchem Products Inc. of Ambler, Pa. entitled: Alodine 12005—Immersion Application, Ridoline 357—Cleaner Spray Application, Deoxidine—Acid Cleaner Immersion Application, Deoxidizer 31—Immersion or Spray Application, Deoxylyte 10—Immersion or Spray Application.

*Primary Examiner*—Shrive P. Beck

*Attorney, Agent, or Firm*—A. J. Moore; H. M. Stanley; R. B. Megley

[57] ABSTRACT

A closed loop method and apparatus is disclosed for spray processing an article such as alodine processing of aluminum. The apparatus includes valved supply and return piping connecting a processing tank with the article therein to a plurality of supply tanks each containing a liquid that is different from the liquid in the other tanks. The valves and two pumps are preferably computer controlled for initiating major steps by circulating liquids from one supply tank at a time through the processing tank for return to the same supply tank. Each major step is followed by an air purging step of at least the return piping for returning sbstantially all flowable liquid into the supply tank from which it originated thereby minimizing contamination of the other liquids. Other apparatus cleans the air of toxic fluids with the environmentally safe air discharged to the atmosphere and the toxic liquids separated into two groups for reuse.

26 Claims, 29 Drawing Figures

FIG_3
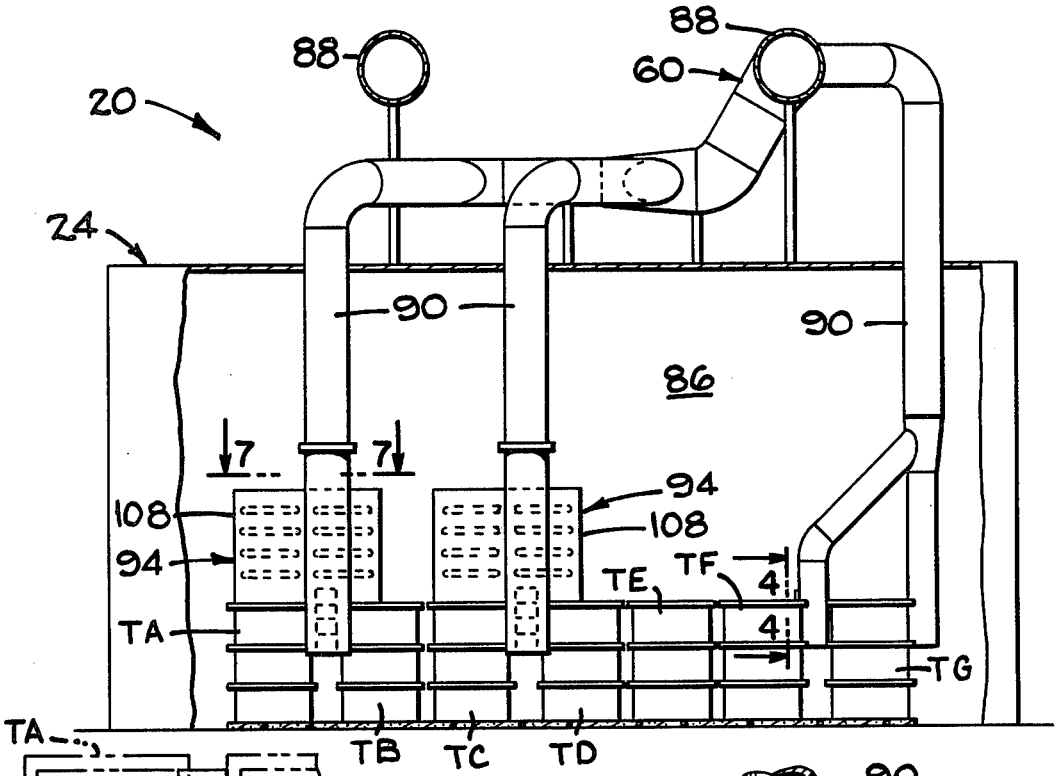
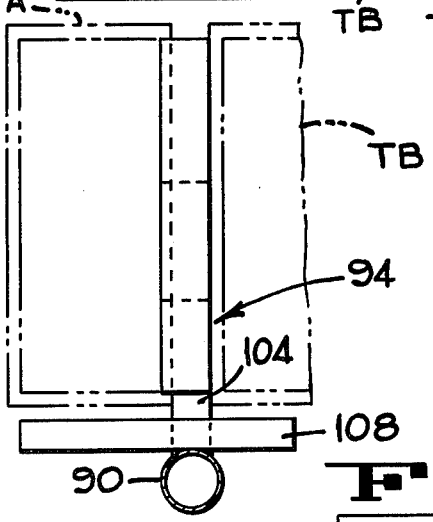
FIG_7
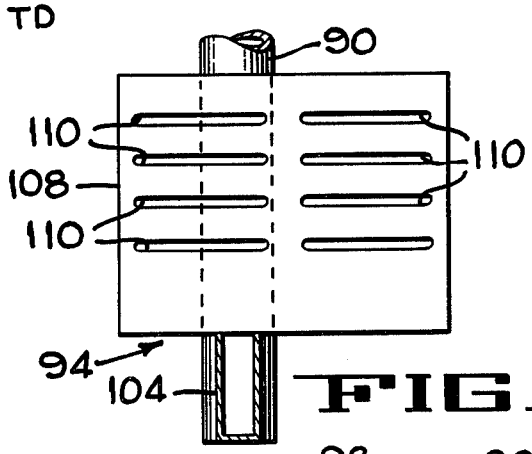
FIG_8
FIG_5
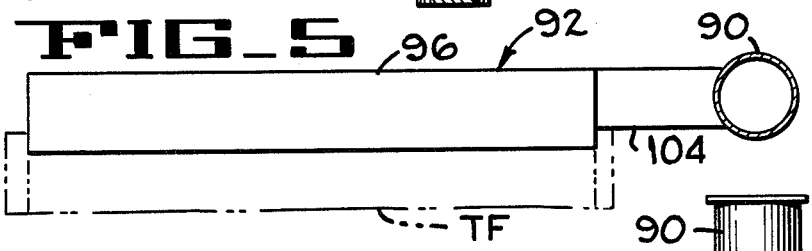
FIG_6
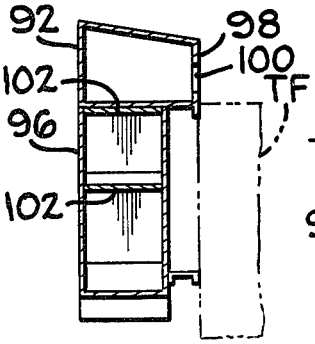
FIG_4
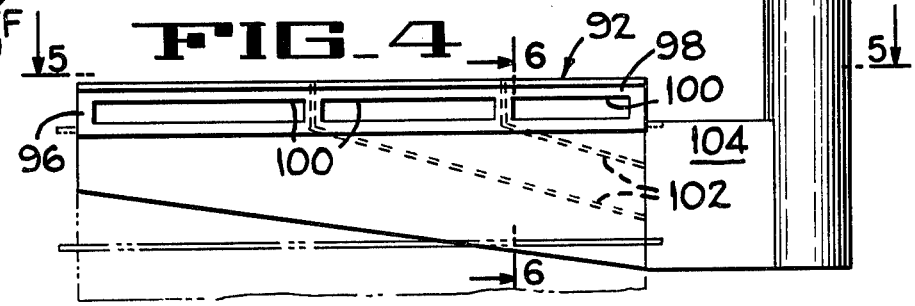

FIG_22A

| PROCESS STEP | | VALVE POSITIONS X = OPEN | | | | | | | | | | | | | | | | | | | PUMP | |
|---|---|---|---|---|---|---|---|---|---|---|---|---|---|---|---|---|---|---|---|---|---|---|
| STEP | DURATION | 1 | 2 | 3 | 4 | 5 | 6 | 7 | 8 | 9 | 10 | 11 | 12 | 13 | 14 | 15 | 16 | 17 | 18 | 19 | P-1 | P-2 |
| 1.0 ALKALINE SOLUTION CLEAN-SPRAY | 5-15 MIN | X | X | | | | | | | | | | | | | | | | | X | X | X |
| 1.1 TERMINATE SPRAY-DRAIN TANK | | | X | | | | | | | | | | | | | | | | | X | | X |
| 1.2 ISOLATE RETURN PIPING FOR PURGE | | | X | | | | | | | | | | | | | | | | | | | |
| 1.3 AIR PURGE RETURN PIPING | 1 MIN | | X | | | | | | | | | | | | | | X | | | | | |
| STEP | | | | | | | | | | | | | | | | | | | | | | |
| 2.0 HOT WATER RINSE-SPRAY | 3-5 MIN | | | X | X | | | | | | | | | | | | | | | X | X | X |
| 2.1 ISOLATE SUPPLY PIPING FOR PURGE | | | | | X | | | | | | | | | | | | | | | X | | X |
| 2.2 AIR PURGE SUPPLY PIPING | 1-3 MIN | | | | X | | | | | | | | | | | X | | | | X | | X |
| 2.3 RINSE PROCESS TANK COVER | 1-3 MIN | | | | X | | | | | | | | | | | | | | X | X | | X |
| 2.4 DRAIN PROCESS TANK | | | | | X | | | | | | | | | | | | | | | X | | X |
| 2.5 ISOLATE RETURN PIPING FOR PURGE | | | | | X | | | | | | | | | | | | | | | | | |
| 2.6 AIR PURGE RETURN PIPING | 1 MIN | | | | X | | | | | | | | | | | | X | | | | | |
| STEP | | | | | | | | | | | | | | | | | | | | | | |
| 3.0 DEOXIDIZE-SPRAY | 5-10 MIN | | | | | | | X | X | | | | | | | | | | | X | X | X |
| 3.1 ISOLATE SUPPLY PIPING FOR PURGE | | | | | | | | | X | | | | | | | | | | | X | | X |
| 3.2 AIR PURGE SUPPLY PIPING | 1-3 MIN | | | | | | | | X | | | | | | | X | | | | X | | X |
| 3.3 DRAIN PROCESS TANK | | | | | | | | | X | | | | | | | | | | | X | | X |
| 3.4 ISOLATE RETURN PIPING FOR PURGE | | | | | | | | | X | | | | | | | | | | | | | |
| 3.5 AIR PURGE RETURN PIPING | 1 MIN | | | | | | | | X | | | | | | | | X | | | | | |
| STEP | | | | | | | | | | | | | | | | | | | | | | |
| 4.0 COLD WATER RINSE-SPRAY | 3-5 MIN | | | | | X | X | | | | | | | | | | | | | X | X | X |
| 4.1 ISOLATE SUPPLY PIPING FOR PURGE | | | | | | | X | | | | | | | | | | | | | X | | X |
| 4.2 AIR PURGE SUPPLY PIPING | 1-3 MIN | | | | | | X | | | | | | | | | X | | | | X | | X |
| 4.3 RINSE PROCESS TANK COVER | 1-3 MIN | | | | | | X | | | | | | | | | | | | X | X | | X |
| 4.4 DRAIN PROCESS TANK | | | | | | | X | | | | | | | | | | | | | X | | X |
| 4.5 ISOLATE RETURN PIPING FOR PURGE | | | | | | | X | | | | | | | | | | | | | | | |
| 4.6 AIR PURGE RETURN PIPING | 1 MIN | | | | | | X | | | | | | | | | | X | | | | | |

FIG_22B

| PROCESS STEP | | VALVE POSITIONS X = OPEN | | | | | | | | | | | | | | | | | | | PUMP | |
|---|---|---|---|---|---|---|---|---|---|---|---|---|---|---|---|---|---|---|---|---|---|---|
| STEP | DURATION | 1 | 2 | 3 | 4 | 5 | 6 | 7 | 8 | 9 | 10 | 11 | 12 | 13 | 14 | 15 | 16 | 17 | 18 | 19 | P-1 | P-2 |
| 5.0 CHROMIC CONVERSION COATING-SPRAY | 1-3 MIN | | | | | | | | | X | X | | | | | | | | | X | X | X |
| 5.1 ISOLATE SUPPLY PIPING FOR PURGE | | | | | | | | | | | X | | | | | | | | | X | | X |
| 5.2 AIR PURGE SUPPLY PIPING | 1-3 MIN | | | | | | | | | | X | | | | | X | | | | X | | X |
| 5.3 DRAIN PROCESS TANK | | | | | | | | | | | X | | | | | | | | | X | | X |
| 5.4 ISOLATE RETURN PIPING FOR PURGE | | | | | | | | | | | X | | | | | | | | | | | |
| 5.5 AIR PURGE RETURN PIPING | 1 MIN | | | | | | | | | | X | | | | | | X | | | | | |
| STEP | | | | | | | | | | | | | | | | | | | | | | |
| 6.0 HOT CHROMIC RINSE-SPRAY | 3-5 MIN | | | | | | | | | | | X | X | | | | | | | X | X | X |
| 6.1 ISOLATE SUPPLY PIPING FOR PURGE | | | | | | | | | | | | | X | | | | | | | X | | X |
| 6.2 AIR PURGE SUPPLY PIPING | 1-3 MIN | | | | | | | | | | | | X | | | X | | | | X | | X |
| 6.3 DRAIN PROCESS TANK | | | | | | | | | | | | | X | | | | | | | X | | X |
| 6.4 ISOLATE RETURN PIPING FOR PURGE | | | | | | | | | | | | | X | | | | | | | | | |
| 6.5 AIR PURGE RETURN PIPING | 1 MIN | | | | | | | | | | | | X | | | | X | | | | | |
| STEP | | | | | | | | | | | | | | | | | | | | | | |
| 7.0 RINSE INDUSTRIAL WATER-SPRAY | 3-5 MIN | | | | | | | | | | | | | X | | | | X | | | X | X |
| 7.1 ISOLATE SUPPLY PIPING FOR PURGE | | | | | | | | | | | | | | | | | | X | | | | X |
| 7.2 AIR PURGE SUPPLY PIPING | 1-3 MIN | | | | | | | | | | | | | | | X | | X | | | | X |
| 7.3 RINSE PROCESS TANK COVER | | | | | | | | | | | | | | | | | | X | X | | | X |
| 7.4 DRAIN PROCESS TANK | | | | | | | | | | | | | | | | | | X | | X | | X |
| 7.5 ISOLATE RETURN PIPING FOR PURGE | | | | | | | | | | | | | | | | | | X | | | | |
| 7.6 AIR PURGE RETURN PIPING | 1 MIN | | | | | | | | | | | | | | | | X | X | | | | |

300
COMPUTER
O0 TO O3
1-04 TO 1-011
2-04 TO 2-011
3-04
302
L1
L2
OFF
OFF
OFF
ON
4PS
1PB
2PB
3PB
1CTR-1
CTR 1
CONTROL POWER
1CTR-2
1CTR-3
STOP
JOG
6PB
5PB
M1
FIXTURE DRIVE M1
1CTR-1
M2
FIXTURE DRIVE M2
START
7PB
1CR
1SS
H
A
3CR-1
2CR
2CR-1
3CR
2CR-2
M3
3CR-2
3-04
SUPPLY PUMP P1
2SS
5CR-1
4CR
4CR-1
5CR
4CR-2
1SOL
5CR-2
O0
ALKALINE CLEANER SUPPLY V1
3SS
7CR-1
6CR
6CR-1
7CR
6CR-2
2SOL
7CR-2
O1
ALKALINE CLEANER RETURN V2
4SS
9CR-1
8CR
8CR-1
9CR
8CR-2
3SOL
9CR-2
O2
HOT RINSE SUPPLY V3

FIG_24

| OUTPUT SCHEDULE | | |
|---|---|---|
| OUTPUT | VALVE OR COIL | DESCRIPTION OR FUNCTION |
| $O_0$ | V 1 | ALKALINE CLEANER SUPPLY |
| $O_1$ | V 2 | ALKALINE CLEANER RETURN |
| $O_2$ | V 3 | HOT RINSE SUPPLY |
| $O_3$ | V 4 | HOT RINSE RETURN |
| $1\text{-}O_4$ | V 5 | COLD WATER RINSE |
| $1\text{-}O_5$ | V 6 | AAW DRAIN |
| $1\text{-}O_6$ | V 7 | DEOXIDIZE SUPPLY |
| $1\text{-}O_7$ | V 8 | DEOXIDIZE RETURN |
| $1\text{-}O_8$ | V 9 | CHROMIC CONVERSION SUPPLY |
| $1\text{-}O_9$ | V 10 | CHROMIC CONVERSION RETURN |
| $1\text{-}O_{10}$ | V 11 | HOT CHROMIC RINSE SUPPLY |
| $1\text{-}O_{11}$ | V 12 | HOT CHROMIC RINSE RETURN |
| $2\text{-}O_4$ | V 13 | INDUSTRIAL WATER SUPPLY |
| $2\text{-}O_5$ | V 14 | INDUSTRIAL WATER SUPPLY |
| $2\text{-}O_6$ | V 15 | COMPRESSED AIR SUPPLY |
| $2\text{-}O_7$ | V 16 | COMPRESSED AIR SUPPLY |
| $2\text{-}O_8$ | V 17 | CHROME DRAIN |
| $2\text{-}O_9$ | V 18 | INDUSTRIAL WATER SUPPLY |
| $2\text{-}O_{10}$ | V 19 | PROCESS TANK DRAIN |
| $2\text{-}O_{11}$ | V 20 | RETURN MANIFOLD PUMP P 2 |
| $3\text{-}O_4$ | 3M | SUPPLY MANIFOLD PUMP P 1 |

CLOSED LOOP PROCESSING OF MATERIALS

BACKGROUND OF THE INVENTION

1. Field of the Invention

The present invention relates to a closed loop method and apparatus for processing materials, preferably metals such as aluminum, in an environmentally safe closed loop process for surface treating the material with the preferred process being the alodine processing of aluminum.

2. Description of the Prior Art

The assignee of the present invention has been alodine processing large aluminum assembly such as aluminum bodies or hulls of military vehicles for a number of years. The bodies have been as large as about 26 feet long, 11 feet wide and 7 feet high. However, this prior art process was slow, taking about 50 to 80 minutes to complete one body, was wasteful of chemicals used during the process due to cross contamination of chemicals resulting in processing cost of about ten times that of the processing cost of the present invention and required considerable expensive materials and equipment to purify rinse water and other liquids used in the process so that the resulting liquid is environmentally safe to be discharged into city sewers or the like.

SUMMARY OF THE INVENTION

In accordance with the present invention a method and apparatus is disclosed which includes a plurality of separate liquid supply tanks each holding a supply of liquid chemicals or water. A processing tank is connected to the supply tanks by supply piping which includes a supply manifold having a plurality of valved inlet ports therein connected to separate ones of the supply tanks and to a compressed air source and an industrial water source. A discharge port in the supply manifold directs the selected liquid through a supply pump and a portion of the supply piping to be sprayed onto the article in the processing tank, which article is rotated during treatment. Return piping is connected between the bottom of the processing tank and the supply tank and includes a return manifold having an inlet port and a plurality of valved outlet ports independently communicating with an associated one of the supply tanks, an acid/alkaline sump or a chrome sump. A centrifugal return pump is included in the return piping between the processing tank and the return manifold.

Additionally, the method of the present invention requires about 35–75 minutes per article when handling a 26 foot long vehicle body and is capable of reducing chemical processing costs to about one tenth of that of assignee's prior method due to air purging which minimizes cross contamination of chemicals and waste of chemicals.

In most of the major steps of the process, compressed air at about 85 psi is used to purge liquid from the supply piping which includes the supply manifold, and the spray nozzles in the spray processing tank. The reclaimed liquid is thereafter pumped from the spray tank into the tank from which it originated. Compressed air is then directed into the return conduits and the return manifold for blowing all liquid from the return piping for returning the liquid from the return piping into the appropriate supply tank from which it was drawn or into one of the sumps.

The above procedure is repeated for most of the supply tanks used in the closed loop process, with the results that each of the chemical liquids used in the process are returned to their supply tanks with very little loss of the chemicals and other liquids, and with very little contamination of one chemical by another.

The chemicals in most of the tanks are heated to the most effective temperature, and air collecting and scrubbing systems are provided for removing substantially all contaminates from the air around the work area and for discharging the environmentally clean air into the atmosphere with the removed contaminants being discharged into the appropriate sumps for return to a waste water acid/alkaline holding tank or a waste water chrome holding tank.

BRIEF DESCRIPTION OF THE DRAWINGS

FIG. 3 is a vertical section taken along lines 3—3 of FIG. 2 illustrating the air purification and scrubbing system.

FIG. 4 is an enlarged side elevation looking in the direction of arrows 4—4 in FIG. 3, of a first type of vapor evacuation hood supported on a supply tank showing the vapor inlet openings of the air purification system being shown slightly above the level of the top of the supply tank.

FIG. 5 is a horizontal section taken along lines 5—5 of FIG. 4 showing the relationship of the vapor inlet openings to the top of the associated supply tank.

FIG. 6 is a section taken along lines 6—6 of FIG. 4.

FIG. 7 is a horizontal section taken along lines 7—7 in FIG. 3 of a second hood extending downwardly between two adjacent supply tanks with an additional hood chamber having air inlet slots for drawing air and fumes away from a walkway between groups of tanks, the vertical outlet duct being shown in section.

FIG. 8 is a section taken along lines 8—8 of FIG. 2 illustrating the vapor inlets of said additional hood chamber of FIG. 7.

FIGS. 22A and 22B when combined define a processing chart illustrating seven major steps and a plurality of minor steps in the process, said chart indicating the duration of the steps; which valves are opened during each minor step, and which pumps, if any, are driven during each minor step.

FIG. 24 is a computer output schedule indicating the computer outputs with the associated processing valves or coils and the functions performed.

DESCRIPTION OF THE PREFERRED EMBODIMENT

The closed loop processing apparatus 20 (FIGS. 1–3), and method of performing the process, will be described as a system for alodine processing of large articles 22 such as the illustrated body or hull of a military vehicle. It will be understood, however, that other types of articles may be treated alone or in batches; and that the invention is not limited to the chemicals used in the preferred embodiment for the alodine processing of aluminum, but that other chemicals may be used for processing other materials for other purposes.

The alodine process of the preferred embodiment of the present invention is used to provide a protective coating on aluminum which minimizes corrosion and provides an improved bond for painting. The alodized surface ranges in color from a light iridescent golden to a tan.

Figure 2:
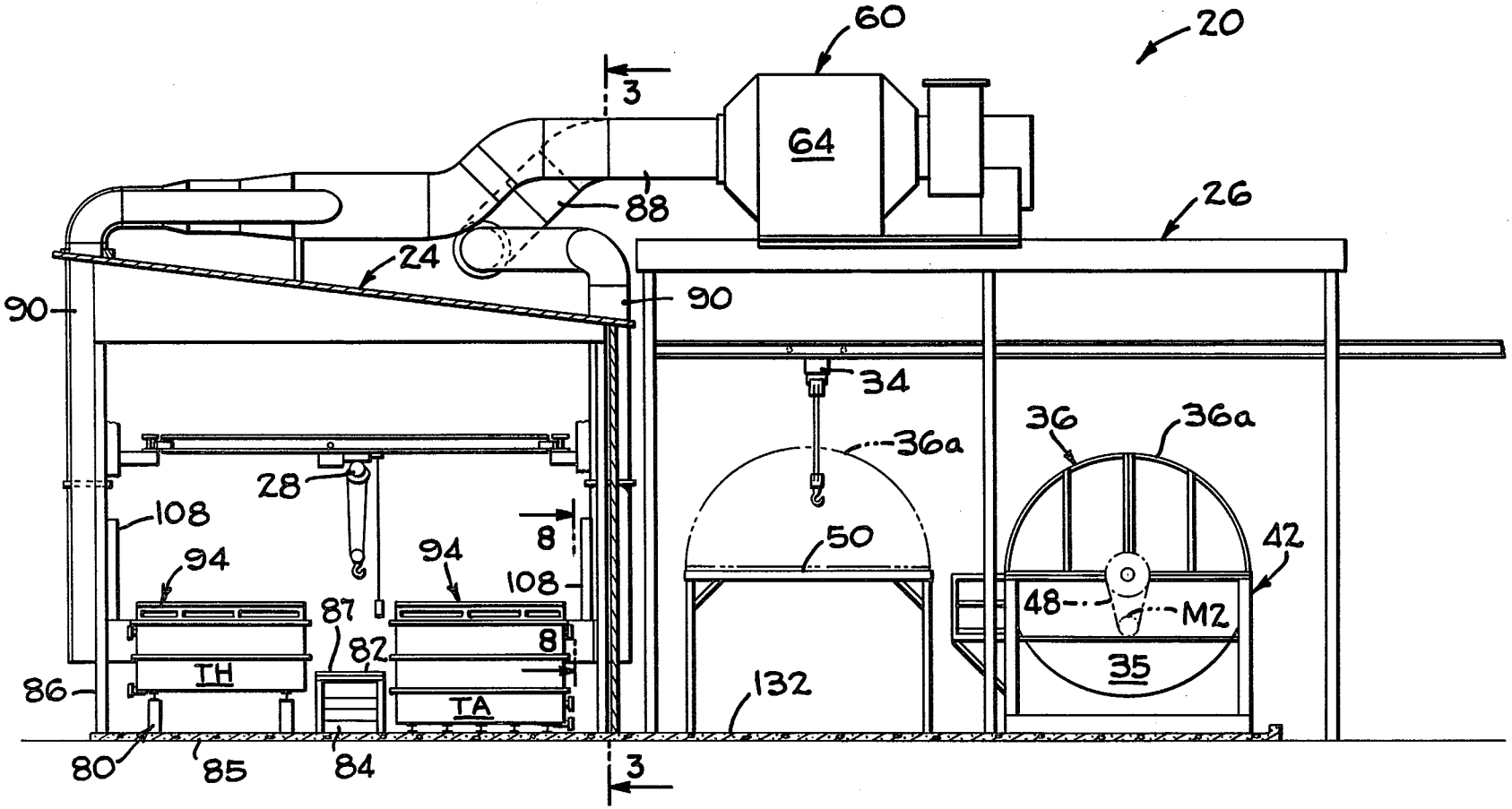
FIG. 2 is a vertical section taken along lines 2—2 of FIG. 1 illustrating the location of several major components including the air purification and scrubbing system, the liquid flow conduit system being omitted for clarity.

In the illustrated preferred embodiment of the invention, the closed loop processing apparatus 20 is enclosed within two buildings 24 and 26. In general, the apparatus includes a plurality of relatively small, open top tanks TA–TG, each filled with a supply of chemicals in liquid form, each of which is different from the chemicals in the other tanks. Other open top tanks TH and TJ–TN are also positioned in the first building 24 and are filled with liquid chemicals that are used for cleaning and stripping paint from smaller metal parts which are carried by and dumped into appropriate tanks by an overhead traveling hoist 28 (FIG. 2). The tanks TH and TJ–TN are not included in the loop processing system but are described because vapors emanating from all tanks within the building 24 must be collected and cleansed before being released into the atmosphere. The liquid in five of the tanks are at ambient temperature while the liquids in the other tanks are raised to a temperature which imparts optimum chemical reactions with the article 22 being processed.

Figure 16:
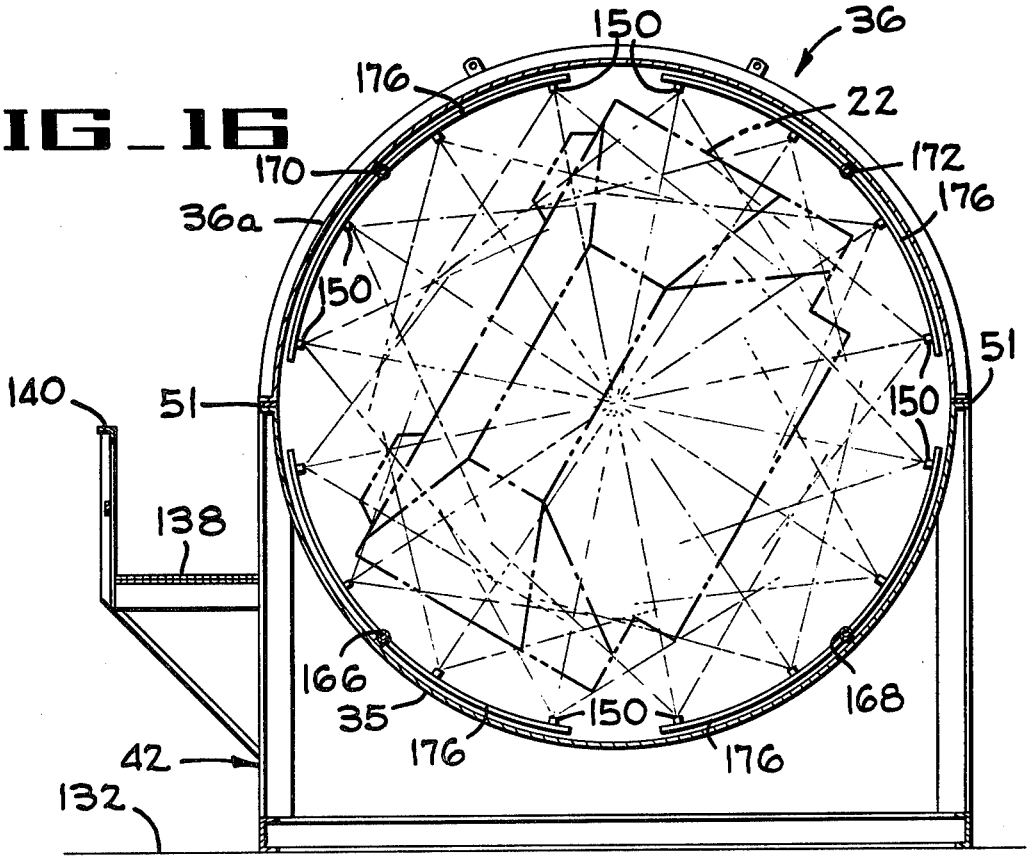
FIG. 16 is a section taken along lines 16—16 of FIG. 13 illustrating the aluminum hull rotated to a different position and further illustrating the spray pattern of the processing liquids.

The article 22 to be processed is pulled into the second building 26 on a trailer 30 by a mobile vehicle (not shown) and is transferred onto a fixture 32 by means of an overhead travel hoist 34. After the article 22 is firmly clamped to the fixture 32, the hoist 34 is used to raise the article and fixture as a unit and place them in the lower portion 35 of a spray processing tank 36 with stub shafts 38 of the fixture 32 rotatably received in concave halves of bearings 40 (FIGS. 13 and 14) mounted on a processing chamber frame 42. The upper halves of the bearings 40 are then secured over the stub shafts 38 as by bolting. The shafts 38 have flats on their outer ends which are connected to yokes 45 on stub shafts 46 by pins 47. Motors M1 and M2 are connected to the shafts 46 by chain drives 48. Before starting the motors 48 to rotate the article 22 and fixture 32 as indicated in FIG. 16, a semi-cylindrical spray tank cover 36*a* is transferred by the hoist 34 from a storage stand 50 (FIG. 2) onto the upper periphery of the lower portion of the spray processing tank 36 with suitable resilient seals 51 disposed therebetween.

Figure 9:
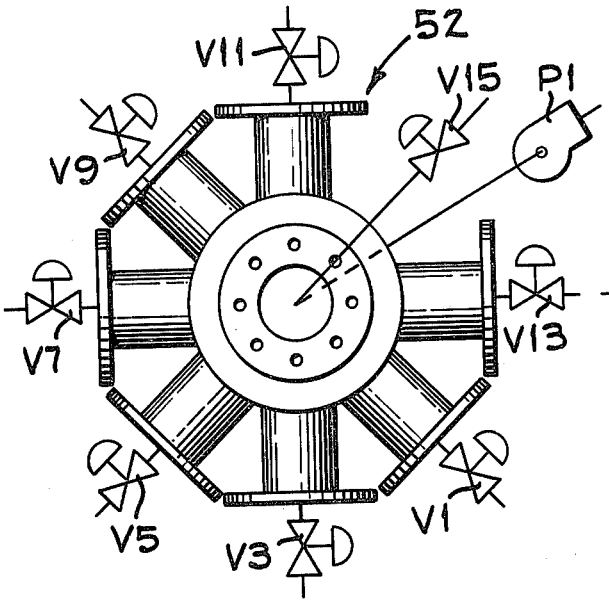
FIG. 9 is a plan of the supply manifold of the conduit system.
Figure 11:
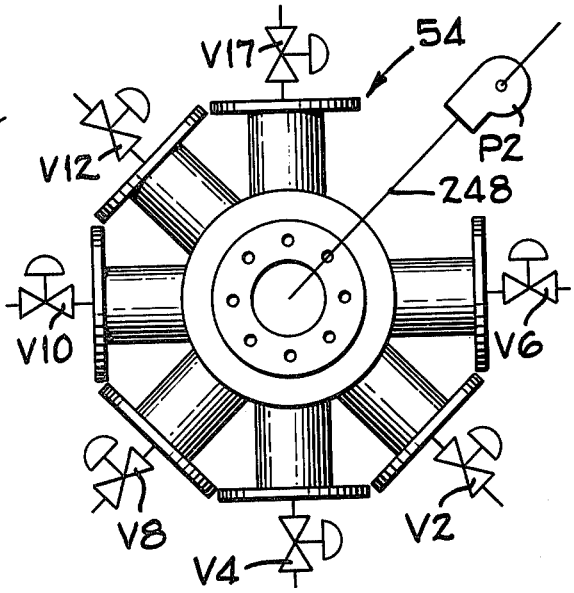
FIG. 11 is a plan of the return manifold of the conduit system.
Figure 10:
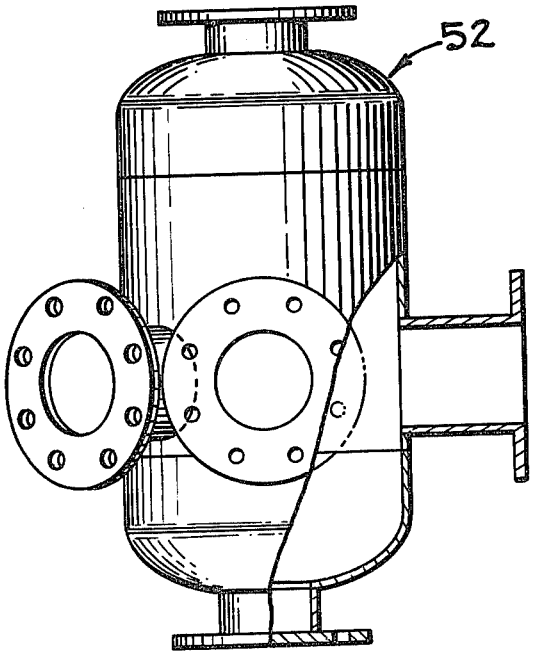
FIG. 10 is a side elevation of the supply manifold of FIG. 9 with parts cut away to illustrate a portion of the interior of the manifold.
Figure 12:
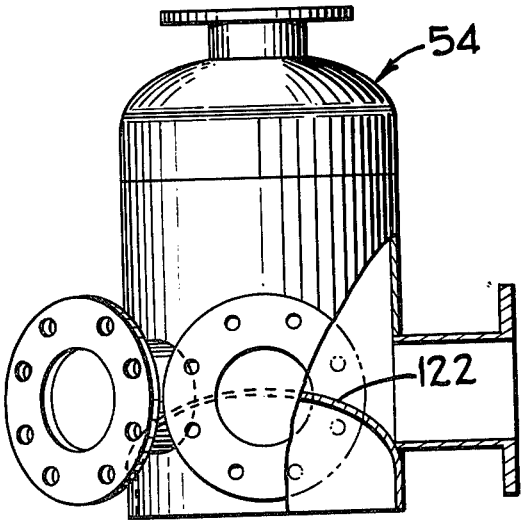
FIG. 12 is a side elevation of the return manifold with parts cut away to illustrate the convex floor thereof.

An important feature of the invention is that a supply manifold 52 (FIGS. 9 and 10) and a return manifold 54 (FIGS. 11 and 12) are located in a conduit system 56 (FIGS. 21A and 21B) and cooperate with a plurality of computer controlled valves and a pair of pumps P1 and P2 for assuring that only one processing liquid at a time is withdrawn from one of the liquid supply tanks TA, TB and TD–TG, and from a water supply line during predetermined timed intervals as determined by a programmed computer. Each selected liquid from its tank is recirculated to the same tank after first being sprayed on the article 22. Before the liquid from another tank is circulated through the spray processing tank 36, high pressure air is pumped through the supply manifold 52, the supply piping and the spray nozzles in the processing tank 36 against the article 22. Compressed air is then forced through the return piping, and the return maifold 54, for discharge into one of the supply tanks or one of two sumps 56 and 58 (FIG. 1) depending upon what type of liquid is being cleansed from the system and from the article as will be described in greater detail later. The high pressure air removes substantially all of the liquid from the conduit system and from the article 22 being treated. This assures that chemical liquids from the different tanks will not contaminate each other and will not be wasted. Also, the air purging step assures that a minimum of chemicals are mixed with rinsing water and that the rinse water can be inexpensively purified so that it can be reused or be environmentally safe for discharge into a sewer.

Another feature of the invention is to assure that caustic chemicals that vaporize from the tanks in the first building 24 are pulled downwardly below the working area of personnel in the building 24 and are then directed through an air purification system 60 which includes a chrome scrubber 62 and an acid/alkaline scrubber 64 before being released to the atmosphere. A waste water acid/alkaline holding tank 66 and a waste water chrome holding tank 68 are provided for maintaining a supply of make-up chemicals for use in the process.

Figure 1:
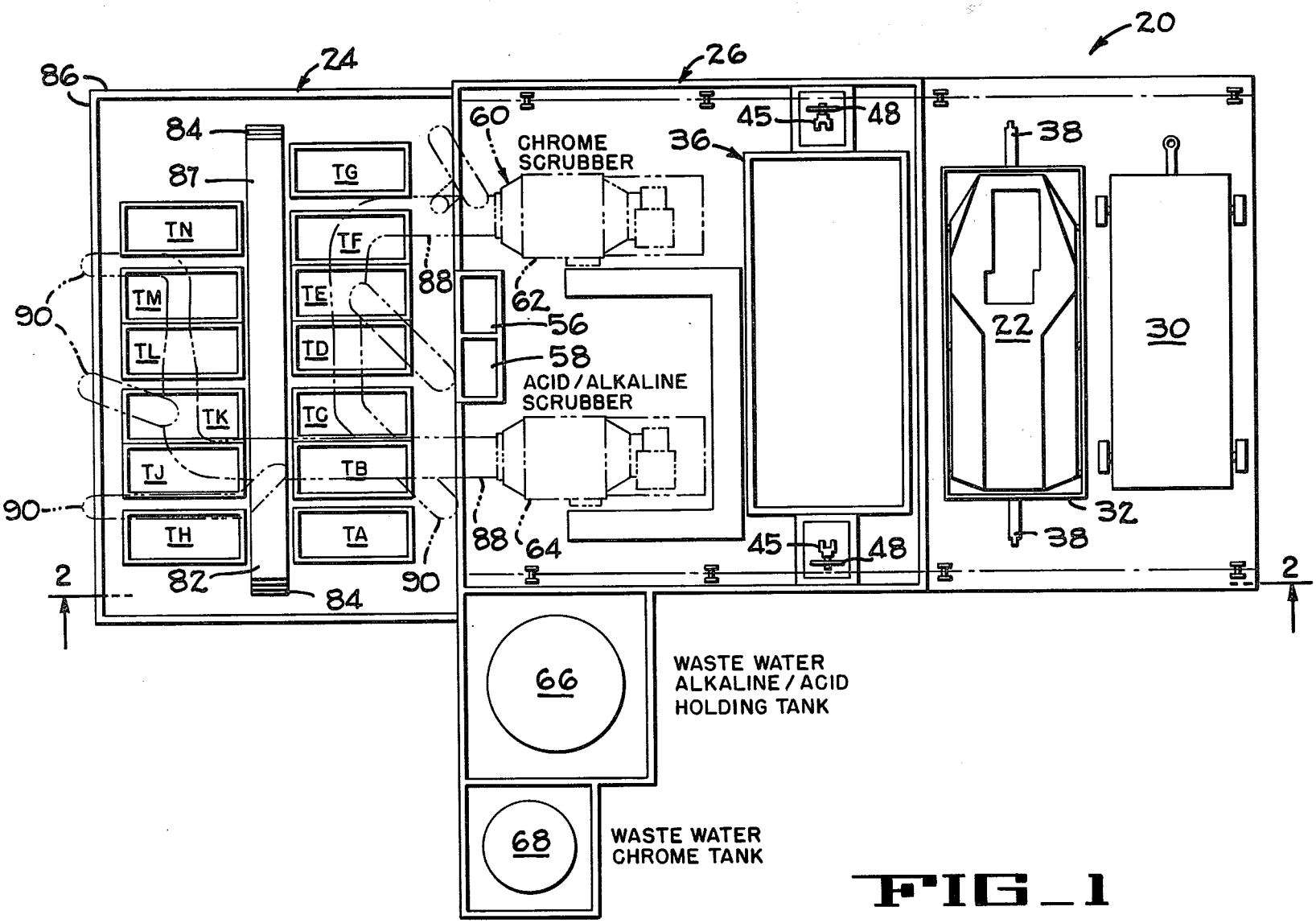
FIG. 1 is a diagrammatic plan view of two buildings enclosing the enclosed loop processing apparatus of the present invention with the roofs of the buildings removed for schematically illustrating the location of major components of the apparatus and with certain components above the roof level being shown in phantom.

More particularly, the tanks TA–TH and TK–TN within the building 24 are mounted on a frame 80 (FIG. 2) having a steel grid floor 82 with stairs 84 between the grid floor and the concrete floor 85 of the building 24, and a walkway 87 between the two rows of tanks. The lower portions of the walls 86 of the building 24, including several doors (not shown) which are closed to substantially prevent air from entering the lower portion of the building from the outside during operation of the closed loop processing apparatus of the present invention. However, air inlet openings (not shown) are provided in the upper portion of the building thereby permitting clean air to circulate downwardly to approximately the level of the top of the supply tanks by the air purification system 60 (FIGS. 1–3). The air purification system 60 comprises the scrubbers 62 and 64 which are 32,000 and 27,000 cubic feet per minute scrubbers, respectively, driven by motors. The scrubbers draw air and fumes across the top of certain tanks through main conduit 88 and branch conduits 90 which extend downwardly to two types of air collecting hoods 92 (FIGS. 4, 5 and 6) and 94 (FIGS. 7 and 8).

Each hood 92 comprises an elongated inlet housing 96 which has a lip 98, with inlet slots 100 therein, extending over one edge of a supply tank. Raffles 102 in the housing 96 define separate passageways from each inlet opening through which air and fumes are drawn by the associated scrubber 62 or 64 through a transition section 104 and into the vertical conduits 90 of the air purification system.

Each hood 94 is similar to the hoods 92 except that it includes an upstanding rectangular chamber 108 which is connected to and communicates with the associated transition section 104. The rectangular chamber 108 extends about 6 feet above the upper surface of a pair of associated supply tanks adjacent the ends of the tanks away from the walkway 87. Horizontal slots 110 are provided in the chamber 108 thereby drawing contaminated air and fumes away from the central walkway and up through the associated scrubber with the contaminated air replaced by clean air in the building 24 which clean air moves downwardly from the top of the building to provide a clean atmosphere for the workmen in the building 24.

The supply maifold 52 (FIGS. 9 and 10) includes seven radial ports, each having a pneumatically operated control valve therein identified as follows:

- V1 which communicates with alkaline tank TA
- V3 which communicates with hot rinse tank TB
- V5 which communicates with rinse tank TD
- V7 which communicates with deoxidize tank TE
- V9 which communicates with chromate conversion tank TF
- V11 which communicates with hot chromic rinse tank TG
- V13 which communicates with an industrial water supply.

The upper end of the supply manifold 52 has a port with a valve V15 thereon which is connected to a source of compressed air at about 85 psi. A port in the lower end of the supply manifold 52 is connected directly to conduits leading to the spray processing chamber 36.

The return manifold 54 has a convex lower floor 122 which is substantially tangent to the longitudinal axes of the seven radial ports. Each radial port has a pneumatically operated, computer controlled valve theron identified as follows:

- V2 which communicates with alkaline tank TA
- V4 which communicates with hot rinse tank TB
- V8 which communicates with aluminum deoxidizing tank TE
- V10 which communicates with chromate conversion tank TF
- V12 which communicates with hot chromic rinse tank TG
- V17 which communicates with the waste water chrome sump 58.
- V6 which communicates with the waste water acid-/alkaline sump 56.

The return manifold 54 also includes a port at its upper end for receiving fluids from the spray tank 36 for discharge into a selected one of the tanks or sumps.

Figure 13:
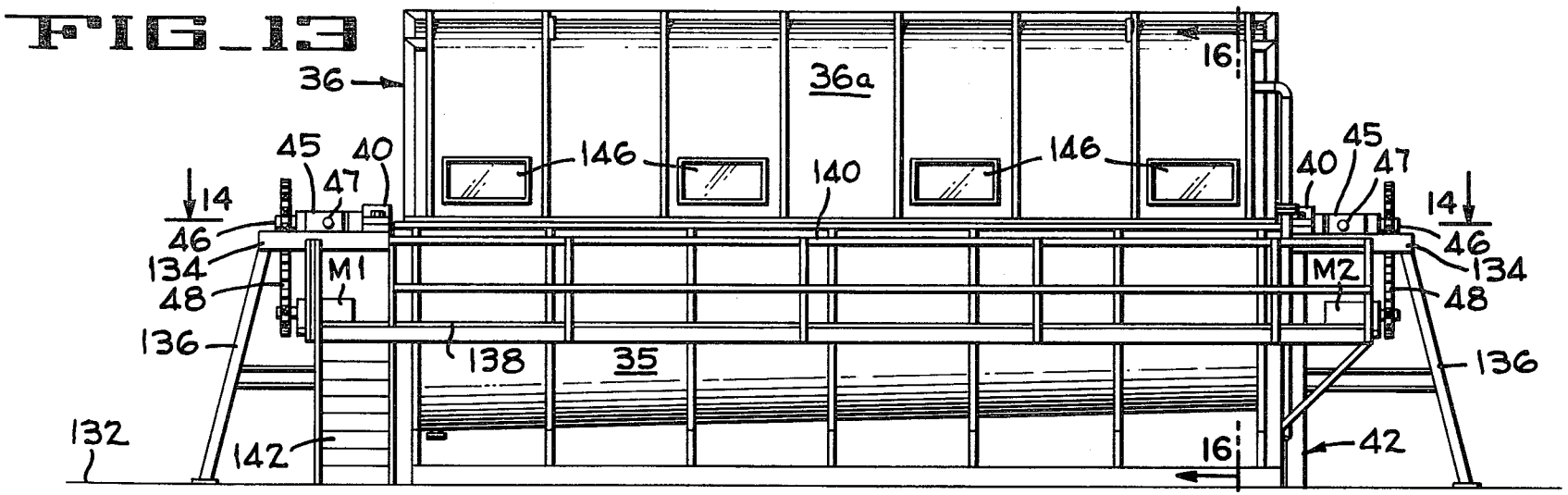
FIG. 13 is an enlarged side elevation of the spray processing tank with its cover in operative position.
Figure 14:
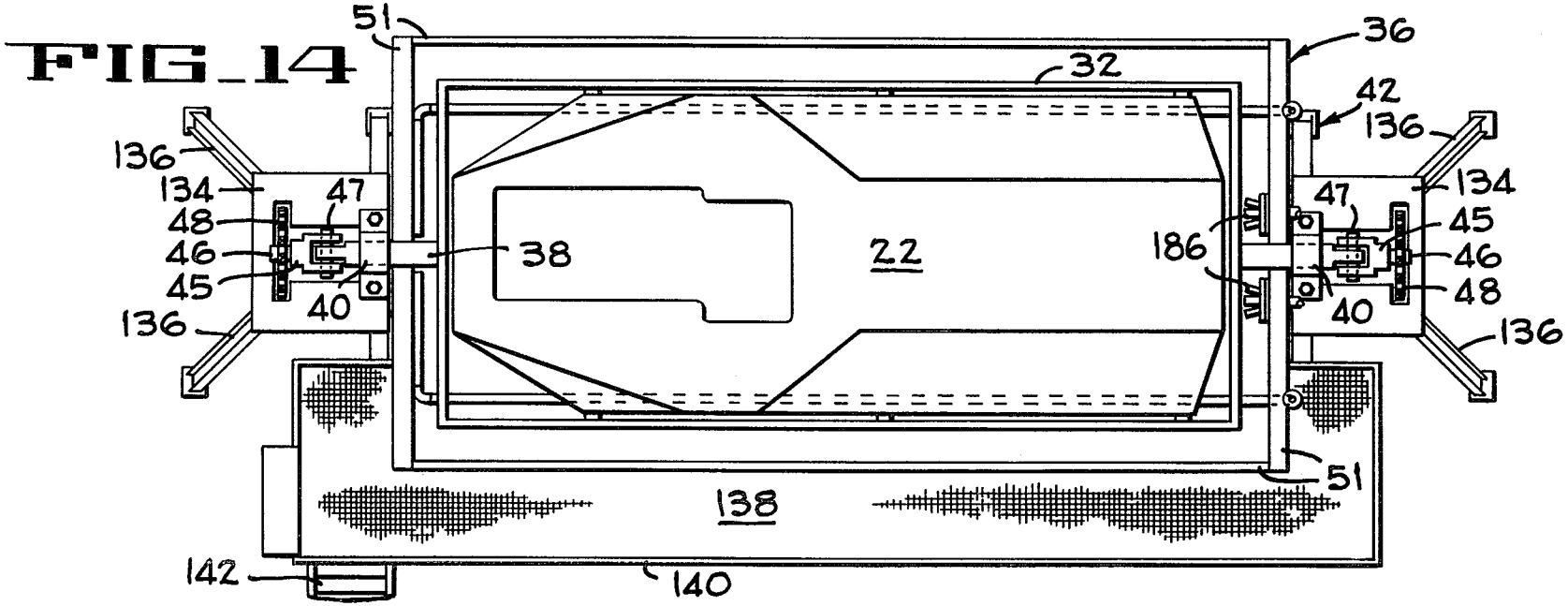
FIG. 14 is a plan looking in the direction of arrows 14—14 of FIG. 13 showing the spray processing tank with cover removed and with the article being treated illustrated as an aluminum hull of a military vehicle shown in processing position.
Figure 15:
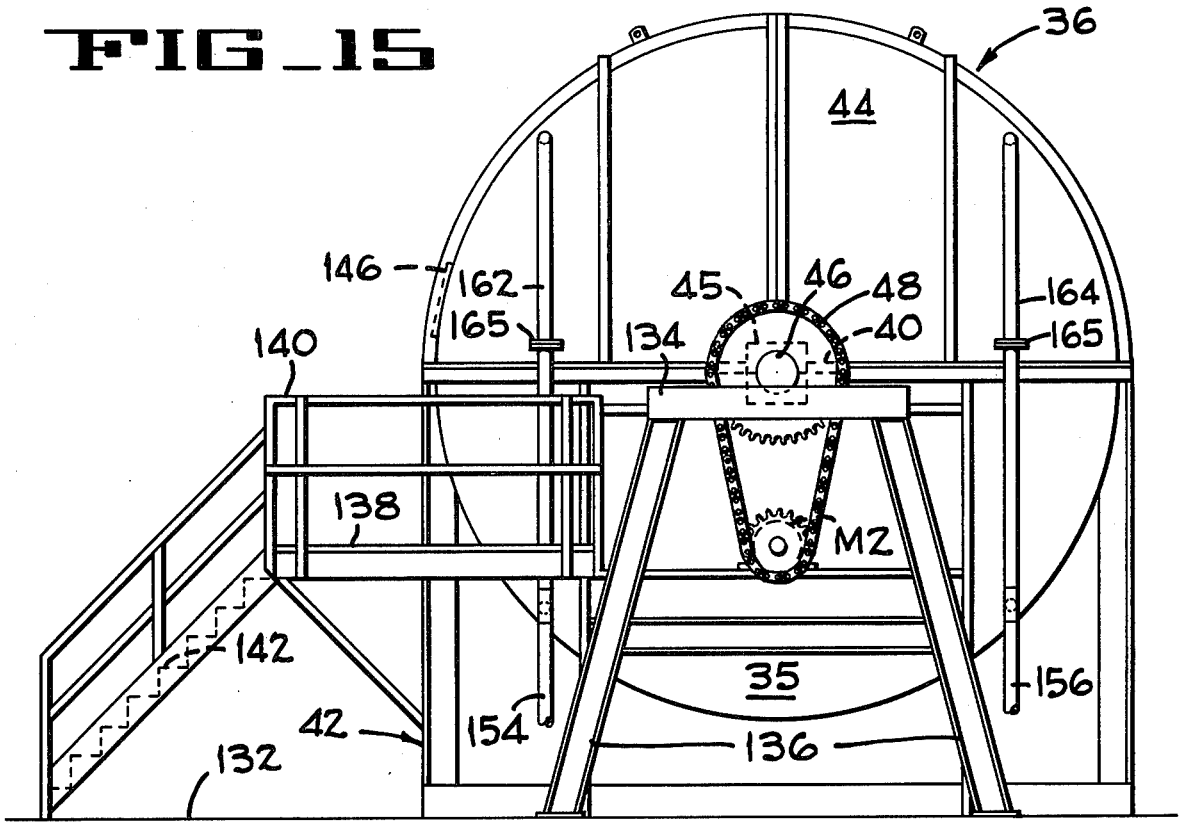
FIG. 15 is an end elevation of the processing tank with the removable cover in operative position on the lower half of the tank.

The spray processing tank 36 is best shown in FIGS. 13–16. The spray tank 36 is mounted on the frame 42 in the second building 26. The frame 42 supports the lower portion 35 of the tank 36 above the concrete floor 132 of the second building 26 as best shown in FIGS. 13 and 15. The frame 42 includes bearing supports 134 on each end thereof having downwardly and outwardly extending feet 136 supported on the floor 132. An elevated catwalk 138 is supported on one side of the frame 42 and is protected by a guide rail 140 with access to the catwalk being provided by stairs 142. The upper half or cover **36*a* of the spray tank 36 is placed upon the lower half 35 with the resilient seal 51 therebetween with the aid of the hoist 34 as previously described. The cover includes windows 146 adjacent the catwalk 138** thereby providing means for personnel to observe the spraying operation when and if desired.

Figure 17:
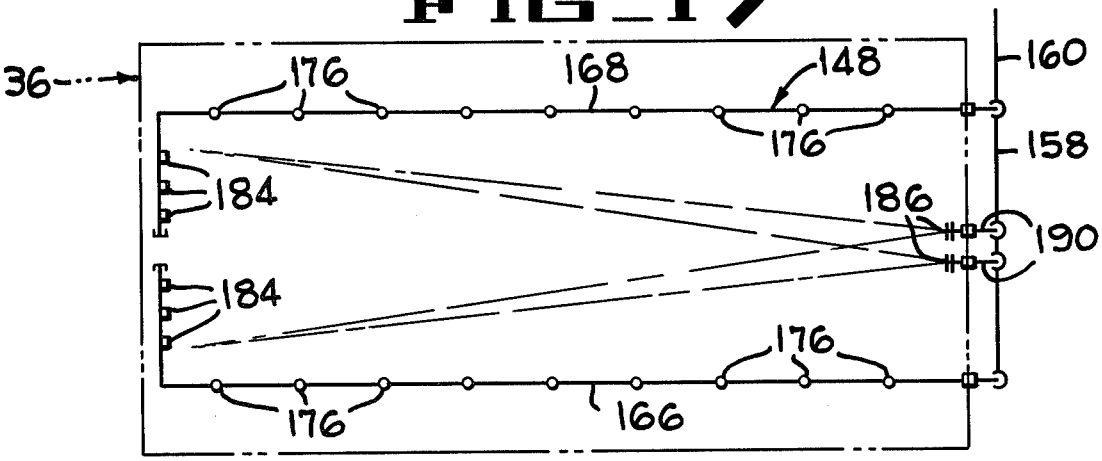
FIG. 17 is a diagrammatic plan of a spray network within the spray tank including the supply conduits externally of the tank with the tank shown in phantom lines.
Figure 18:
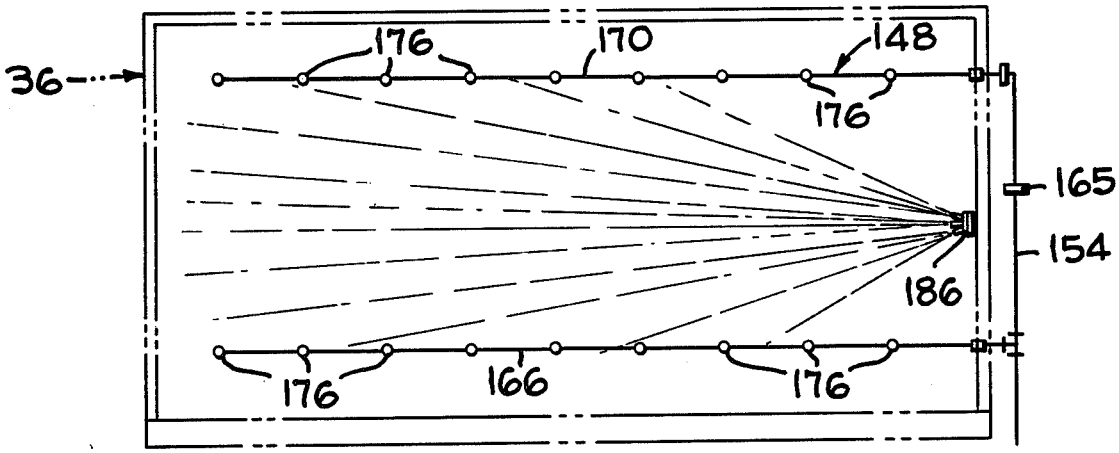
FIG. 18 is a side elevation of the spray network of FIG. 17, with the spray tank shown in phantom lines.

A network 148 of conduits and spray nozzles 150 are diagrammatically illustrated in FIGS. 16–19 and show the arrangement of the spray nozzles 150 within the spray tank 36. The piping externally of the tank 36 is in a generally U-shaped configuration including two upstanding inlet pipes 154,156 rigidly secured to the lower portion 35 of the tank 36 and connected to each other by a horizontal pipe 158 (FIG. 19) which receives fluid from a pipe 160 communicating with the supply pump P1. The upstanding lower pipes 154,156 are connected to upstanding pipes 162,164 secured to the cover 44 by couplings 165. The pipes 154,156, 162,164 are connected to longitudinally extending conduits or headers 166,168,170,172 extending through and sealed to the adjacent end wall of the lower and upper halves of the tank 36 as indicated in FIGS. 17 and 18. In the preferred embodiment, each header 166,168,170,172 has 18 arcuate spray pipes 176 connected thereto with two spray nozzles 150 on each arcuate spray pipe. Each nozzle 150 is preferably a Steiner "fan-jet" type No. 3 with a capacity of about 1.5 gallons per minute at 10 pounds per square inch gauge pressure. In the preferred embodiment 72 arcuate pipes are provided with two "fan-jet" nozzles on each arcuate pipe.

Figure 19:
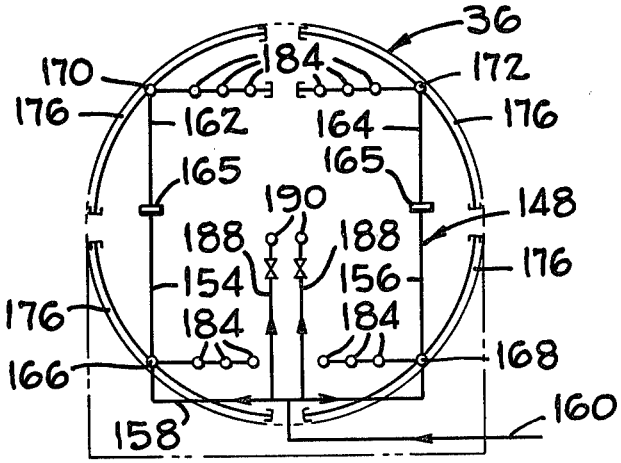
FIG. 19 is an end elevation of FIG. 17.
Figure 20:
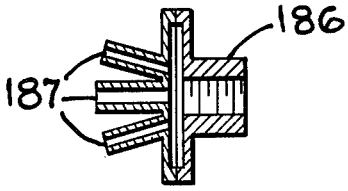
FIG. 20 is an enlarged vertical section of one of the multiple port spray nozzle assemblies used at one end of the spray tank.

In order to spray the ends of the article 22, a plurality of nozzles 184, six being illustrated in FIGS. 17 and 19, communicate with the horizontal headers 166,168,170,172 to direct fluid against the end of the article 22 remote from the inlet pipes 154,156. The right (FIG. 17) end of the article 22 is sprayed by a pair of multiple port spray nozzle assemblies 186 (FIG. 20), each having eight ports drilled into the face of the associated nozzle assembly at different angles between 10° to 50° from the vertical plane of the assembly 186. Each assembly has a three inch long, one-half inch diameter pipe 187 welded over the spray ports to better control the spray pattern against the article 22. Spray fluid is directed into the nozzle assembly 186 by upright pipes 188 (FIG. 19) having horizontal portions 190 extending through and sealed to the adjacent end wall of the lower portion 35 of the tank 36. The network of conduits 148 within the spray tank 36 is mounted to the tank in such a way as to avoid trapping pools of liquid in the tank 36. The spray pattern of fluid in the spray tank is illustrated in FIGS. 16–18.

Figure 21A:
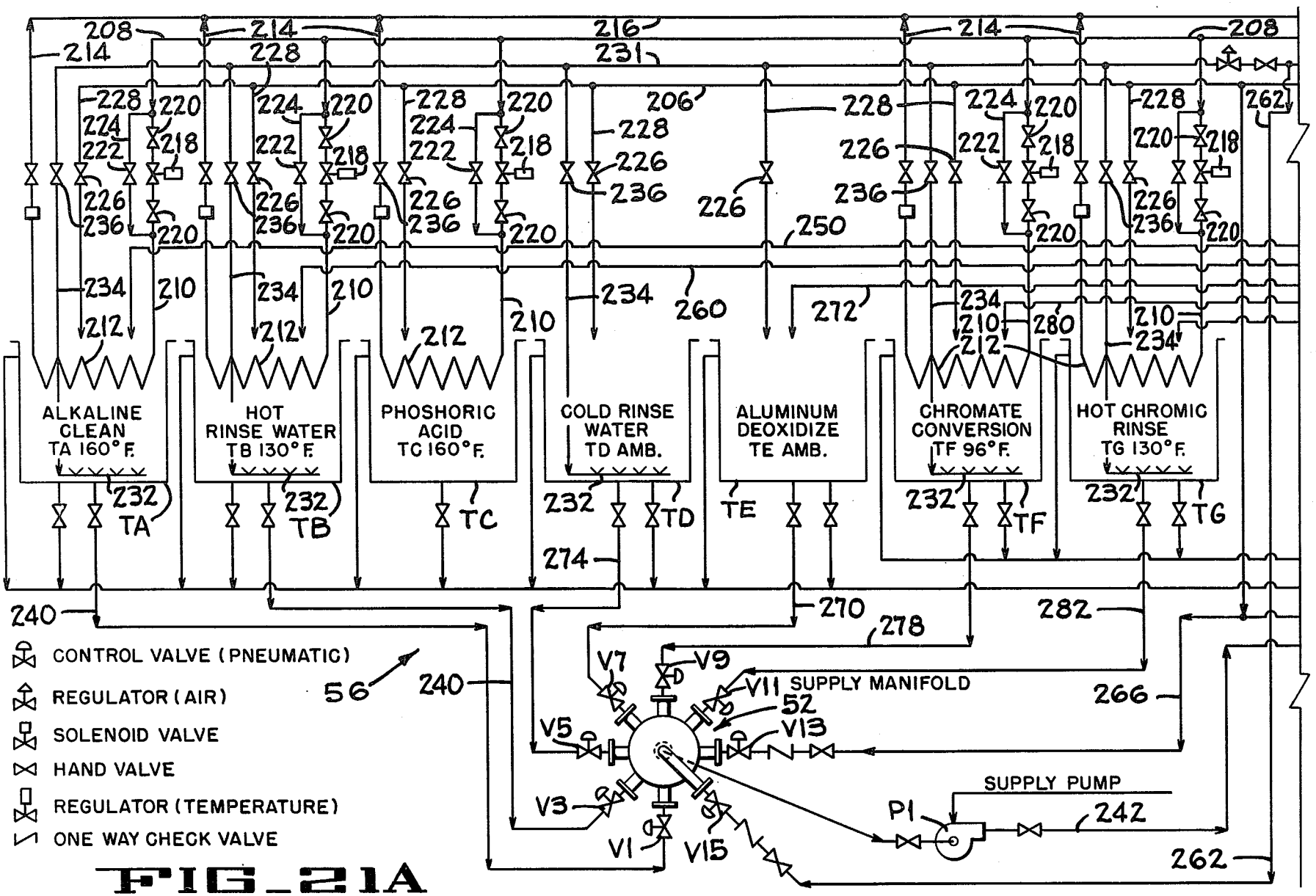
FIGS. 21A and 21B when combined constitutes a process flow diagram for the apparatus of the present invention.
Figure 21B:
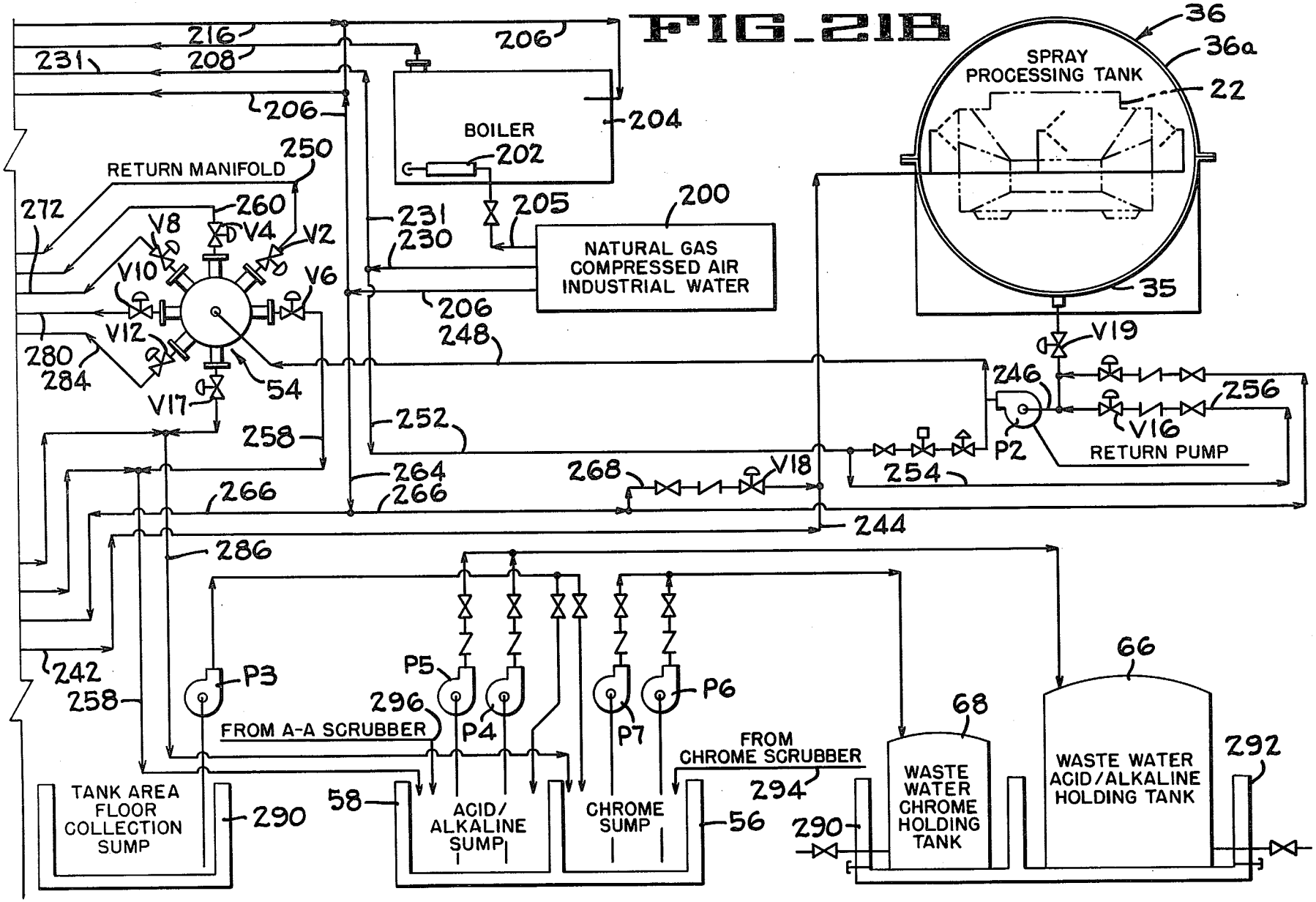

FIGS. 21A and 21B when combined diagrammatically illustrates the process flow diagram of fluid in the illustrated preferred embodiment of the invention and will be described in conjunction with the steps as set forth in FIGS. 22A and 22B for setting fort the sequence of operations of the major and minor steps of the preferred embodiment.

As shown in FIG. 21B, natural gas, compressed air at about 85 psi and industrial water enters the system from an outside source generally designated 200.

The natural gas is directed into the burner 202 of a boiler 204 through a conduit 205; and water from the source 200 is directed into the boiler through conduit 206 and conventional controls (not shown) for generating steam used to heat the liquid in several of the supply tanks. The steam flows from a main conduit 208 through branch lines 210 and heating coils 212 with the condensed steam returning to the boiler 204 through branch lines 214 and a main condensate return line 216 for reheating and recirculation. As shown in FIG. 21A, the cleaning alkaline solution in tank TA is heated to 160° F.; the hot rinse in tank TB is heated to 130° F.; the phosphoric acid in tank TC is heated to 180° F.; the rinse water in tank TD is at ambient temperature of about 68° F.–80° F.; the aluminum deoxidizing liquid in tank TE is at ambient temperature; the chromic conversion liquid in tank TF is heated to about 96° F.; and the hot chromic rinse in tank TG is heated to about 130° F.

A temperature regulator 218 is included in each steam branch line 210 of each of supply tank being heated for regulating the temperature in the associated tank to the above mentioned temperatures. Also, a pair of hand operated valves 220 are provided in each steam branch line 210, and another hand operated valve 222 is provided in a parallel bypass conduit 224 so that the system may be manually operated in the event a temperature regulator becomes defective and must be removed.

Makeup water from water conduit 206 may be directed into each supply tank in response to opening a hand operated valve 226 in branch conduits 228 associated with each tank when makeup water is required or the tank is to be filled with water. Similarly, compressed air from the outside source 200 flows through conduits 230, 231 into several heated tanks through spargers 232 which are connected to the main air conduit by branch conduits 234 having hand valves 236 therein.

After the liquids in the supply tanks TA–TG reach the proper temperature, the operational steps of the automatic conversion coating system, as outlined in FIGS. 22A and 22B is started. As mentioned previously, the operational steps are preferably controlled by a computer and will be described hereinafter. The operational steps include seven major steps, with each major step including several minor steps.

The first processing step (step 1.0, FIG. 22A) involves spraying the alkaline cleaning solution in tank TA onto the article 22 in the spray tank 36. Valves V1, V2, and V19 (FIGS. 22A, 21A and 21B) are opened; and pumps P1 and P2 are started. Pump P1 draws the alkaline cleaning solution from tank TA through conduit 240, valve V1, supply manifold 52, pump P1 and conduits 242 and 244 into spray processing tank 36 through the previously described spray nozzles 150. The alkaline cleaning solution returns the liquid to supply tank TA from the bottom of the spray tank 36 through open valve V19, conduit 246, pump P2, conduit 248, open valve V2 in return manifold 54, and conduit 250 into tank TA. The alkaline cleaning solution is circulated as above described for between about 5–15 minutes and then the alkaline spray cycle is terminated and the spray tank 36 is drained.

Draining of the spray tank 36 is initiated by step 1.1 (FIG. 22A) by closing valve V1, leaving valves V2 and V19 open, stopping pump P1, and driving pump P2 while leaving all the other pneumatically operated valves closed. The alkaline solution is then drained from the bottom of the spray tank 36 through open valve V19, conduit 246, centrifugal return pump P2, conduit 248, return manifold 54 and conduit 250 into the supply tank TA thus reclaiming all flowable alkaline solution from the spray tank 36 and from the above return piping or conduits between the spray tank and the supply tank TA. The return piping as used herein and in the claims includes the return manifold 54.

The return piping is then isolated for purging as indicated in 1.2 (FIG. 22A) at which time all pneumatic valves except valve V2 are closed and the pumps P1 and P2 are stopped. Purging of the return liins (step 1.3) is initiated by opening valves V6 in return manifold 54 and valve V16 for about one minute thus causing high pressure air at about 85 psi to flow from source 200 through conduits 230,252, 254 and 256, valve V16, conduit 246, centrifugal pump P2, conduit 248, manifold 54, valve V6, and a conduit 258 to acid/alkaline sump 58 thus purging all liquid from the return piping.

The above processing steps assure that substantially all of the alkaline cleaning solution in the return piping is returned to its supply tank TA, and that the return piping including the return manifold 54 are likewise substantially cleansed of the alkaline solution.

It will be noted that the above step is the only step in which the supply piping is not purged by compressed air. The reason for eliminating the air purging of the supply piping is primarily to save time in the initial cleaning step, and because the lost cleaning chemical is relatively inexpensive and is collected in the next step with the hot rinse water.

The next major step in the process (steps 2.0–2.6 in FIG. 18) is to rinse the article 22 being treated and the piping with the hot rinse water from supply tank TB.

In order to initiate the hot rinse cycle, valves V3, V4 and V19 are opened and pumps P1 and P2 are started. Rinse liquid from tank TB then flows through conduit 240, open valve V3, manifold 52, pump P1, conduits 242,244 and is then sprayed against article 22 in the spray tank 36 through the spray nozzles. The rinse liquid is returned to tank TB through open valve V19, conduit 246, pump P2, conduit 248, into the upper end of return manifold 54, out open valve V4 and conduit 260 into tank TB. The rinse liquid is circulated for about 3–5 minutes, and then the supply piping is isolated (step 2.1 in FIG. 22A) by closing valve V3, stopping pump P1 and leaving valves V4 and V19 open with pump P2 running.

In step 2.2, valves V4, V15 and V19 are opened and high pressure air is used to purge the supply lines, the supply manifold 52, and the spray nozzles and spray tank 36 including the article therein. During air purging, air flows from source 200, through conduits 230, 231; a conduit 262 and valve V15 into the upper end of the supply manifold 52. Air flows out of the supply manifold 52 through its lower opening, through pump P1, conduits 242 and 244, and through the spray nozzle assembly within the spray tank 36. The purged liquid and air in the tank 36 is drained therefrom and flows through open valve V19, conduit 246, is pumped by pump P2 through conduit 248, return manifold 54, open valve V4 and conduit 260 for returning the rinse liquid to supply tank TB. The supply piping is air purged as above described for about 1-3 minutes.

The next step is a hot water rinse step (step 2.3) for rinsing the processing tank cover 36*a* and is performed with valves V4, V18 and V19 open and with pump P2 running for a period of about 1.3 minutes. Industrial water from the outside source 200 then flows through conduits 206, 264, 266, 268 and open valve V18 into conduit 244 and through the spray nozzles within the tank 36. After the cover 44 has been rinsed for the desired period, valve V18 is closed leaving valves V4 and V19 open and the pump P2 running as indicated in step 2.4. Water is then drained from spray tank 36 through open valve V19, conduit 246, pump P2, conduit 248, return manifold 54, open valve V4, and conduit 260 for discharge into the hot rinse tank TB. The industrial water drained from spray tank 36 thus replaces hot rinse water in tank TB which has been lost due to evaporation or discharge into the acid/alkaline sump 58.

The return piping is then isolated in step 2.5 by closing all valves except valve V4 and by stopping both pumps P1 and P2. The return piping is then purged with compressed air at about 85 psi for about one minute as indicated in step 2.6 (FIG. 22A) with only valves V4 and V16 being open. High pressure air from outside source 200 then flows through conduits 230,252,254,256, open valve V16, conduit 246, pump P2, conduit 248, return manifold 54, open valve V4 and conduit 260 for discharge of the collected liquid into the hot rinse water tank TB.

The article 22 in the spray tank 36 is then deoxidized by having an aluminum deoxidizing solution from tank TE sprayed thereon for a period of about 5-10 minutes. As indicated in step 3.0 (FIG. 22A) valves V7, V8 and V19 are opened and pumps P1 and P2 are driven for the 5-10 minute period. The deoxidizing liquid then flows from supply tank TE through a conduit 270, open valve V7, the supply manifold 52, pump P1, conduits 242 and 244, and through the spray nozzles in the spray tank 36 for discharge onto the article 22 being treated. The liquid is discharged from the spray tank 36 through open valve V19, conduit 246, pump P2, conduit 248, return manifold 54, open valve V8 and a conduit 272 for return to the aluminum deoxidizing solution tank TE. After the solution has been recirculated for 5-10 minutes, the valve V7 is opened and the pump P1 is stopped thereby isolating the supply piping for purging as indicated in step 3.1 (FIG. 22A) with valves V8 and V19 open and pump P2 running.

The supply piping is then air purged for 1-3 minutes with valve V8, V15 and V19 open and pump P2 running as shown in step 3.2 (FIG. 22A). Air at about 85 psi flows from outside supply source 200 through conduits 230,231,262, open valve V15, supply manifold 52, pump P1, conduits 242 and 244, and into spray tank 36 through the spray nozzles therein. The collected liquid and air in the supply tank 36 are then discharged through open valve V19, conduit 246, pump P2, conduit 248, return manifold 54, open valve V8 and the liquid is returned to supply tank TE through conduit 272 thus minimizing loss of the aluminum deoxidizing fluid.

Valve V15 to the supply manifold 52 is then closed leaving valves V8 and V19 open and pump P2 is driven for draining the spray processing tank 36 as shown in step 3.3. Any remaining liquid in tank 36 then flows out of the spray tank 36 through open valve 19, and conduit 246 into pump P2 which pumps the liquid through conduit 248, return manifold 54, valve V8 and conduit 272 into supply tank TE.

The return piping is then isolated (step 3.4) by closing all valves except valve V8 and stopping pumps P1 and P2. The return piping is then purged by air at about 85 psig for about 1 minute after opening valves V8 and V16 as indicated in step 3.5 (FIG. 22A). High pressure air received from air supply source 200 flows through conduits 230,252,254, and 256 open valve V16, pump P2, conduit 248, return manifold 54, open valve V8 and thereby returns all flowable liquid to the aluminum deoxidizing solution supply tank TE.

The next series of steps involve rinsing the aluminum deoxidizing solution out of the piping, spray tank and manifolds with cold rinse water sprayed from supply tank TD, and followed by cleansing with outside industrial water as indicated in steps 4.0 to 4.6 (FIG. 22A).

Step 4.0 is started by opening valves V5, V6 and V19 and starting pumps P1 and P2 which pump cold water for about 3-5 minutes through the piping and into the acid/alkaline sump 58. Cold water from supply tank TD flows through the conduit 274 and open valve V5 into the supply manifold 52, through pump P1, conduits 242 and 244, and through spray nozzles in the spray processing tank 36 to spray the cold rinse water on the article 22 and the internal surfaces of the tank 36. The water flows out of spray tank 36 through open valve V19, conduit 246, pump P2, conduit 248, return manifold 54, open valve V6 and through conduit 258 into acid/alkaline sump 58.

After the 3-5 minute rinse cycle, the supply piping is isolated for air purging at which time valve V5 is closed and only valves V6 and V19 remain open and pump P2 is driven. The air pumping step (step 4.2 of FIG. 22A) is then initiated with valves V6, V15 and V19 being opened and pump P2 being driven. High pressure air from source 200 then flows through conduits 230, 231, 262, open valve V15, supply manifold 52, pump P1, conduits 242 and 244 and into the spray processing tank 36 through the spray nozzles therein to flush all flowable liquid from these components. The water in the tank 36 flows through open valve V19, conduit 246, driven pump P2, conduit 248, return manifold 54, valve V6, and conduit 258 for discharge into the acid/alkaline sump 58.

The spray processing tank cover 36*a* is then rinsed by clean water from outside source 200 for about 1-3 minutes with valves V6, V18 and V19 open and return pump P2 running as indicated in step 4.3. During this step water flows through conduits 206,264,266,268, open valve V18, conduit 244, and is sprayed against the cover 36*a* and article within the spray processing tank 36 by the spray nozzles within the spray tank. The water then flows out of spray processing tank 36 through open valve V19, conduit 246, pump P2, conduit 248, return manifold 54, open valve V6, and conduit 258 to acid/alkaline sump 58. With the cover 36*a* rinsed for 1–3 minutes, valve V18 is closed, and valve V6 and V19 remain open with pump P2 running. The water remaining in the tank is then drained from the spray tank 36 through open valve V19, conduit 246, pump P2, conduit 248, return manifold 54 valve V6, and conduit 258 to acid/alkaline sump 58 as indicated in step 4.4.

In step 4.5 the return piping is isolated for air purging by opening only valve V6 with all other valves closed and both pumps stopped. Air is then purged from the return piping (step 4.6) after valves V6 and V16 have been opened and both pumps are stopped. The air at about 85 psi then flows from outside supply source 200 through conduits 230,252,254, and 256, through open valve V16, through conduit 246, pump P2, conduit 248, return manifold 54, open valve V6 and conduit 258 to the acid/alkaline sump 58.

During the next processing cycle (step 5.0) a chromic conversion coating liquid from supply tank TF is sprayed on the article for a period of about 1–3 minutes. During this step, valves V9, V10 and V19 are open and pumps P1 and P2 are driven. The chromic conversion solution then flows from tank TF through a conduit 278, open valve V9, the supply manifold 52, pump P1, conduits 242 and 244 and into the processing tank 36 through the spray nozzles therein which direct the chromic conversion coating solution onto the article 22 within the tank 36. The liquid then flows through open valve V19, conduit 246, pump P2, conduit 248, return manifold 54, valve V10, and a conduit 280 for return to supply tank TF for reheating to about 96° F. and recirculation for about 1–3 minutes.

The supply piping is then isolated for air purging by closing valve V9 and leaving valves V10 and V19 open with pump P1 stopped and pump P2 running as indicated in step 5.1 (FIG. 22B). In step 5.2, valves V10, V15 and V19 are opened and pump P2 is running for a period of between about 1–3 minutes. Compressed air from outside power source 200 then flows through conduits 230,231,262, open valve V15, supply manifold 52, pump P1, conduits 242 and 244 and into the spray processing tank 36 against the article 22 through the spray nozzles therein. The air and collected liquid flows out of spray tank 36, through open valve V19, conduit 246, pump P2, conduit 248, return manifold 54, and open valve V10 for return to the chromic conversion tank TF. After the 1–3 minute air purging step has been completed, the spray processing tank 36 is drained as disclosed in step 5.3 at which time valves V10 and V19 are open and pump P2 is driven. Any flowable liquid remaining in the spray tank 36 flows through open valve V19, conduit 246, and is pumped by pump P2 through conduit 248, return manifold 54, valve V10 and conduit 280 for return to the chromic conversion tank TF.

The return piping is then isolated for air purging by closing all valves except valve V10 and stopping the pumps P1 and P2. The return piping is then air purged for about 1 minute (step 5.5) at which time valve V10 and V16 are open and the pumps P1 and P2 are stopped. Air flow from source 200, conduits 230, 252,254,256, valve V16, pump P2, conduit 248, return manifold 54, open valve V10 and conduit 280 to hot chromate supply tank TF.

Step 6.0 involves the spraying of a hot chromic rinse for a period of about 3.5 minutes on the article 22 in the spray processing tank 36. During this rinsing step valves V11, V12 and V19 are open and pumps P1 and P2 are driven. The hot chromic rinse of fluid at about 130° F. flows from supply tank TG through a conduit 282, open valve V11, the supply manifold 52, pump P1, conduits 242,244 into spray tank 36 and is sprayed onto the article 22 therein by the spray nozzles in the tank. The liquid is drained from the tank through open valve V19, conduit 246, pump P2, conduit 248, return manifold 54, and open valve V12 for return to the supply tank TG through a conduit 284.

After the hot chromic rinse has been circulated for about 3.5 minutes, the supply piping is isolated for air purging by closing all valves except valve V12 and V19 and driving only pump P2. The air puring step is initiated when valve V12, V15 and V19 are opened and pump P2 is operated. Compressed air then flows from outside source 200, through conduit 230,231,262, open valve V15, supply manifold 52, pump P1, conduits 242 and 244, and is then sprayed on the article 22 within the spray tank 36 for a period of about 1–3 minutes. The purged liquid is drained from the spray tank 36 through open valve V19, conduit 246, pump P2, conduit 248, return manifold 54, and open valve V12 for return to the hot chromic rinse supply tank TG through conduit 284.

After the 1–3 minute purging step is completed, the spray processing tank is drained as indicated in step 6.3 at which time valves V12 and V19 are open and pump P2 is driven. The fluid in spray tank 36 flows through open valve V19, conduit 246, driven pump P2, conduit 248, return manifold 54, open valve V12 and conduit 284 for return to hot chromic rinse tank TG.

The return piping is then isolated for air purging (step 6.4) by closing all valves except valve V12 and stopping pumps P1 and P2. During the air purging step 6.5, valves V12, and V16 are opened and the piping is purged for about 1 minute. The compressed air at about 85 psi is received from outside source 200 and flows through conduits 230,252,254,256, open valve V16, conduit 246, pump P2, conduit 248, return manifold 54, open valve V12 and a conduit 284 to hot rinse tank TG.

Step 7.0 involves rinsing of the system with industrial water from outside source 200 for a period of about 3 to 5 minutes. Valves V13 and V17 are opened and pump P1 and P2 are started to initiate the cycle. Industrial water flows from outside source 200, through conduits 206,264,266, open valve V13, supply manifold 52, pump P1 and conduits 242 and 244 through the spray nozzles in spray tank 36 against the article 22 therein.

After the 3–5 minute cycle, all valves are closed except valve 17 and only pump P2 is driven for isolating the supply piping for air purging as indicated in step 7.1. The air purging cycle is then started by opening valves V15, V17 and V19 and driving only pump P2 for a period of 1–3 minutes. Compressed air then flows from outside supply 200 through conduits 230,231,262, open valve V15, supply manifold 52, pump P1, conduits 242,244 into spray tank 36 through nozzles therein.

The spray processing tank cover is then rinsed in response to opening valves V17,V18 and V19 as indicated in step 7.3. The industrial water then flows from source 200, conduits 206,264,266,268, open valve V18 and conduit 244 into the spray tank 36 for discharge therein through the spray nozzles.

The spray processing tank 36 is then drained after closing all valves except valve V17 and V19 and driving pump P2 as indicated in step 7.4. The liquid in tank 36 then drains through open valve 19, conduit 246, pump P2, conduit 248, return manifold 54, open valve V17 and flows into the chromic sump 56 through a conduit 286. The return piping is then isolated for air purging by closing all valves except valve V17 and stopping both pumps P1 and P2 as indicated in step 7.5.

High pressure air at about 85 psi is then circulated through the return piping for about 1 minute after first opening valve V16 and V17 as indicated in step 7.6 (FIG. 22B). Compressed air at about 85 psi then flows from the outside source 200, through conduits 230, 252,254,256, open valve V16, conduit 246, pump P2, conduit 248, open valve V17 and conduit 286 into the chromic sump 56.

After the computer controlled process is completed, which includes all of the steps from step 1.0 to step 7.6 illustrated in FIGS. 22A and 22B, the article has been properly coated, can be removed from the spray processing tank 36 and be replaced by another article to be treated. In this regard, the traveling hoist 34 is first connected to the cover 36*a* of the spray tank 36 and is controlled to lift the cover above the article 22 and transfer the cover to the storage stand 50. The upper halves of the bearings 40 and the pins 47 (FIG. 14) are then removed and the hoist 34 is released from the cover and connected to the fixture 32 lifting the fixture and finished article 22 from the lower portion of the tank 36 and depositing them on the concrete floor of the second building 26 as illustrated in FIG. 1. The article is then released from the fixture 32 and the hoist 34 is connected to the article 22 and transfers the article to one of the trailers 30 (FIG. 1) for removal from the building permitting an untreated article on another trailer to be pulled into the second building 26. The hoist is then used in a reverse manner to place the untreated article 22 onto the fixture and then move both into the spray tank 36 and place the cover thereon as previously described.

Having reference to FIG. 21B, the chrome waste water holding tank 68 is shown positioned in a chrome waste water collecting sump 290 in the event the chrome tank 68 should be ruptured or should leak. The acid/alkaline waste water holding tank 66 is likewise placed in a sump 292 for collecting any alkali discharge from the tank 66.

A pump P3 is provided to pump leakage in the chrome waste water collecting sump 290 into the chrome sump 56. A pair of acid/alkaline pumps P4 and P5 are provided to transfer waste water from acid/alkaline sump 58 into acid/alkaline waste water holding tank 66. Similarly, two pumps P6 and P7 are provided for transferring chrome waste water from the chrome sump to the chrome waste water holding tank 68. It will also be noted that waste water from the chrome scrubber is discharged into the chrome sump 56 from conduit 294; and the waste water from the acid/alkaline scrubber enters acid/alkaline sump 58 through conduit 296.

In order to provide a complete disclosure, applicants will list the contents of the several tanks when the process is used for its preferred purpose of alodining aluminum. The following chemicals for the alodine processing of aluminum are provided by Amchem Products, Inc., Ambler, PA. The liquid in the seven tanks are as follows:

Tank TA—Alkaline cleaner—Ridoline 357—12.5 lb per 100 gallons

Tank TB—Hot rinse water at about 160° F.

Tank TC—Deoxidizing acid cleaner—Deoxidine 25—50 gallons per 100 gallons

Tank TD—Cold rinse water

Tank TE—Aluminum deoxidize—Deoxidizer 31—75 gallons water, 4 gallons 66° Bé Sulfuric acid—10 gallons Deoxidizer 310 Make-Up to make 100 gallons Tank TF—Chromate Conversion—Deoxylate 10 ⅛ to ¼ pint per 100 gallons Tank TG—Hot Chromic Rinse Hot water at about 130° F.

Figure 23A:
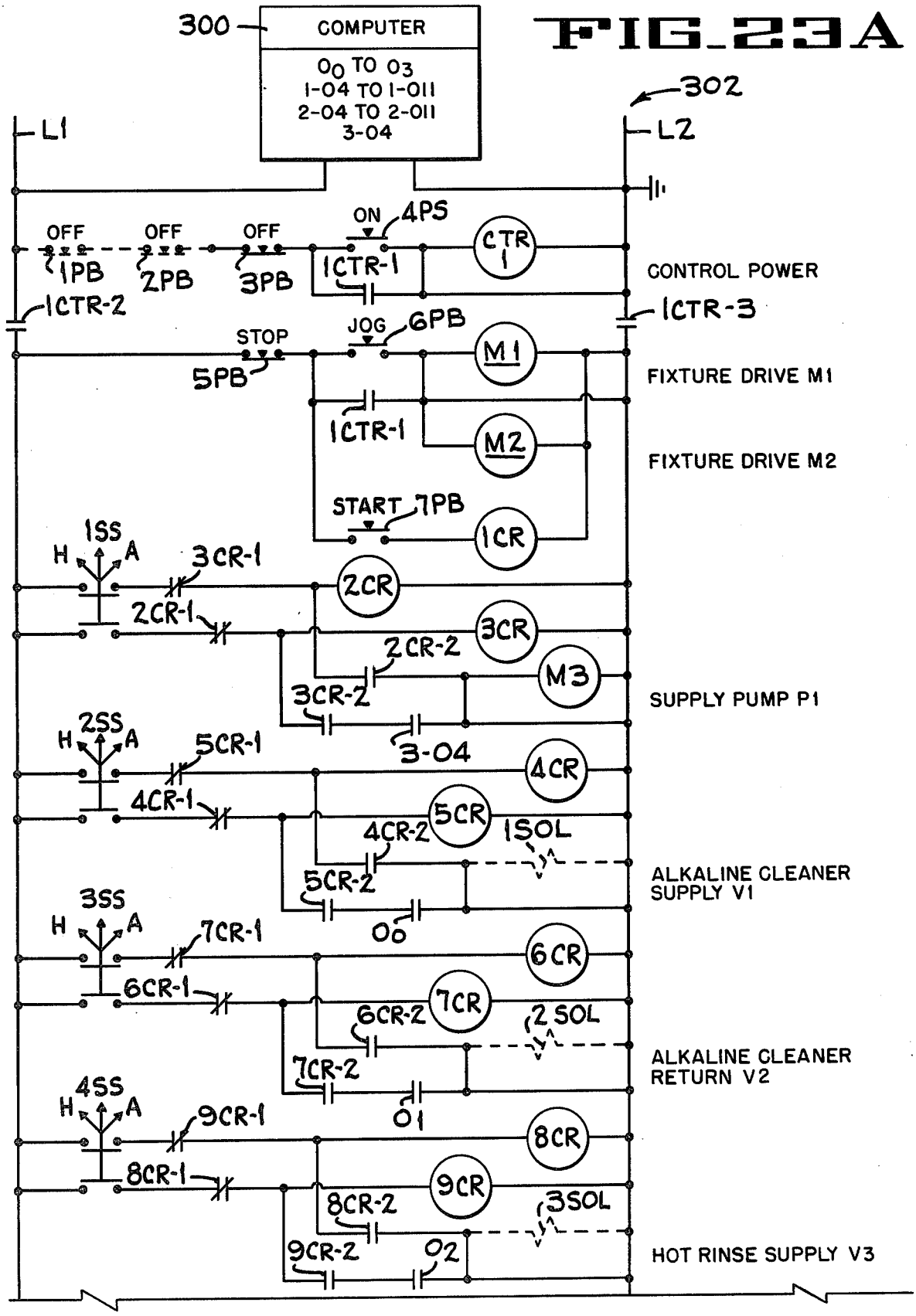
FIGS. 23A to 23D when combined define a manual hand operated or computer controlled wiring diagram for operating the two pumps and the many solenoid operated valves illustrated in the process flow diagram of FIGS. 22A and 22B.
Figure 23B:
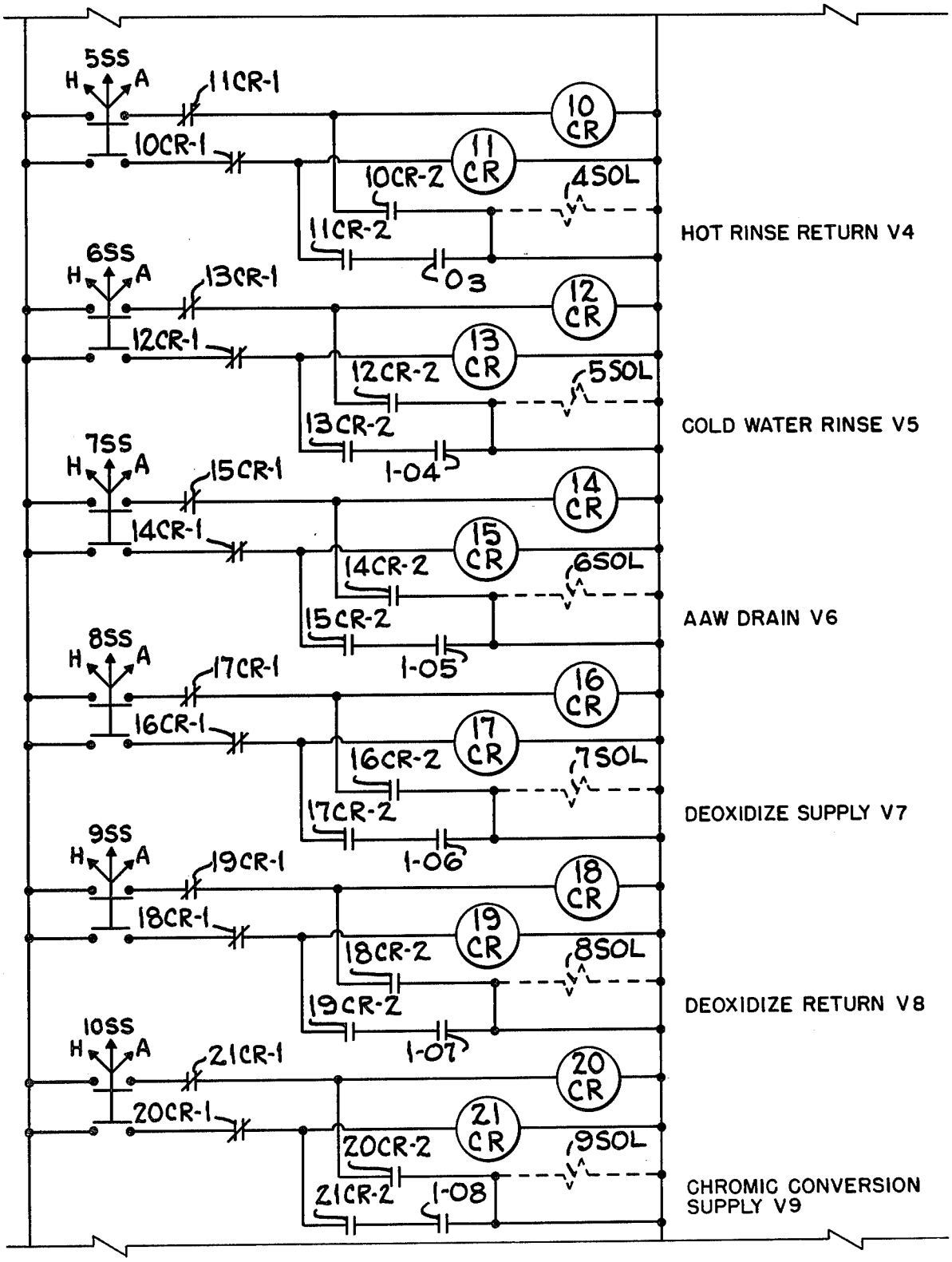
Figure 23C:
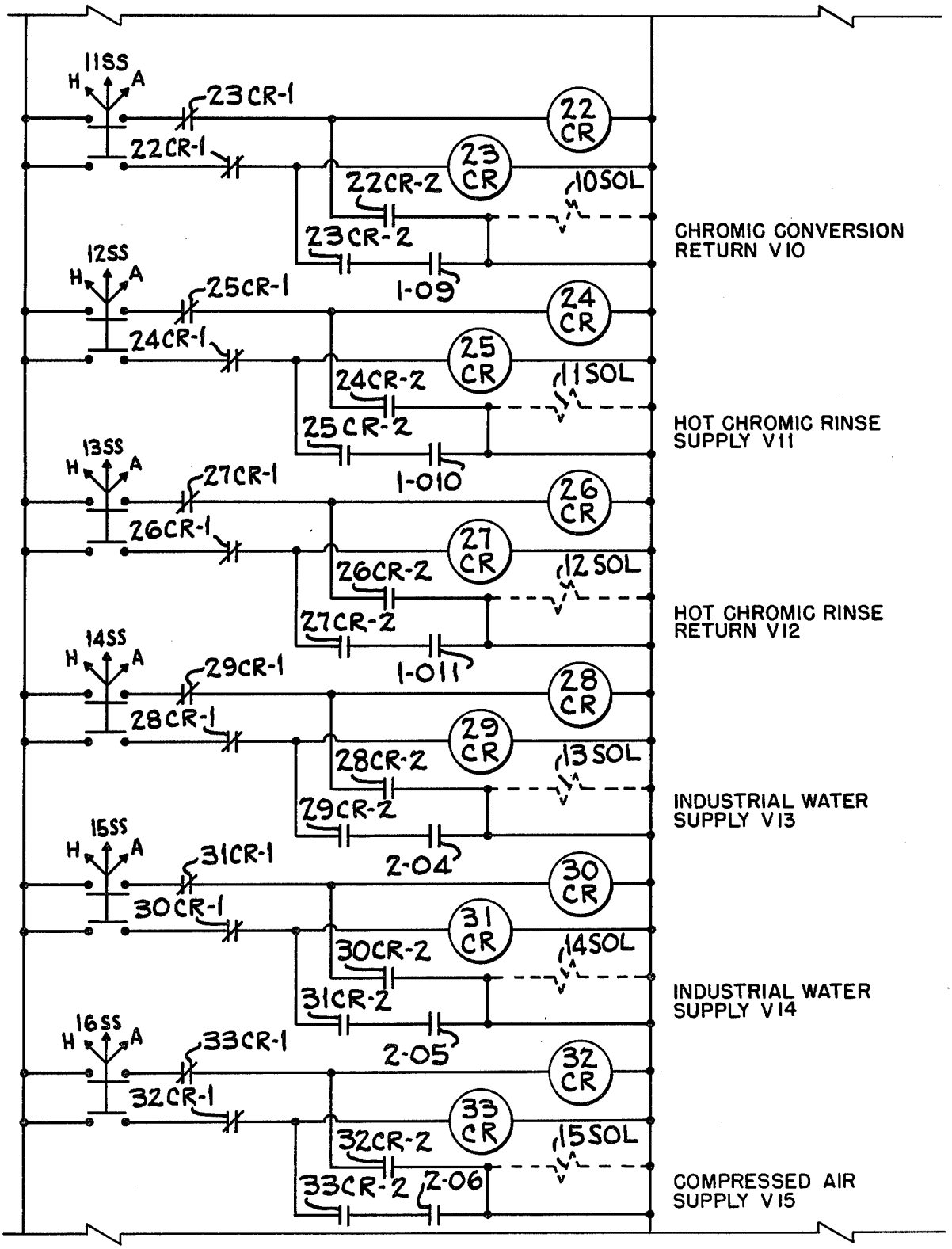
Figure 23D:
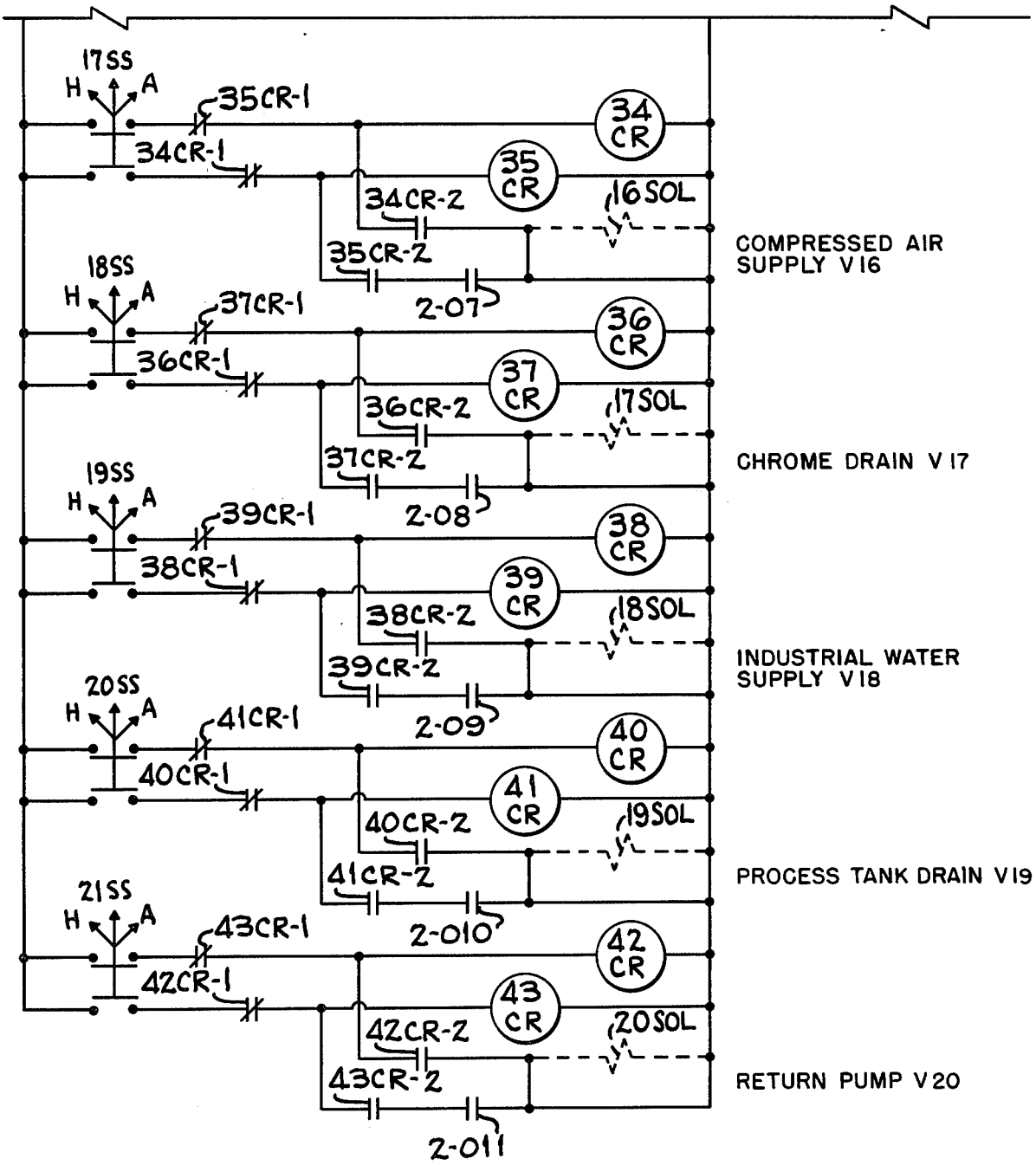

As mentioned previously, the several pneumatic valves and the pumps P1 and P2 used in the above described flow diagram may be manually controlled but are preferably controlled by a computer 300 (FIG. 23A) programmed for the sequence of operations and timing illustrated in the chart of FIGS. 22A and 22B. The computer 300 is preferably a microprocessor of the WP6000 Series MicroMaster, manufactured by Minarik Electric Company Masters of Control, Los Angeles, CA 90013.

The electrical controls and computer outputs associated with pump motors P1 and P2, and the valves V1–V19 are illustrated in the electric diagram of FIGS. 23A–23D, and the computer output schedule of FIG. 24. Certain standard electrical components such as instrument lights and overloads have been omitted for simplicity. The computer functions, timing and sequence of operation of the valves V1–V19 and of the pumps P1 and P2 are shown in FIGS. 22A and 22B.

Having reference to FIGS. 23A–23D, a control circuit 302 includes main lines L1 and L2 which receive 120 volt alternating currents from an outside source. Power is directed into main lines L1 and L2 by closing "ON" switch 4PB which energizes relay CTR-1 closing holding circuit 1CTR-1 in parallel with "ON" switch 4PS, and relay contacts 1CTR-2 and 1CTR-3 in main lines L1 and L2, respectively. A plurality of "OFF" switches 1PB, 2PB and 3PB are at different locations around the processor 20 for emergency stopping of the processor.

The two fixture drive motors M1 and M2 are started either by a jog switch 6PB or a start switch 7PB, each of which energizes a relay 1CR which closes a holding contact 1CR-1 across the switches. Stop switch 5PB is manually engaged to stop the motors M1 and M2.

The circuit for supply pump P1 is started by closing a three position selector switch 1SS either in the hand "H" operated or automatically "A" operated position. When closed in the hand operated position, relay 2CR is energized through normally closed relay contact 3CR-1. Energizing relay 2CR closes relay contact 2CR-2 thereby driving supply pump motor 3M through closed contact 2CR-2. Energization of relay 2CR also opens relay contact 2CR-1 thereby disabling the automatic or computer circuit to motor 3M of supply pump P1. When selector switch 1SS is placed in automatic "A" relay 3CR is energized which opens 3CR-1 in the hand "H" operated circuit thereby disabling the hand circuit to motor 3M, but closing relay contact 3CR-2 which energizes motor 3M to drive pump P1 only when the computer output 3-04 (FIG. 23A) is closed by the computer.

Valve V1 (FIG. 23A) is energized by closing three position switch 2SS either in the hand "H" position or the automatic position. When closed in the hand or manual position, relay 4CR is closed opening contact 4CR-1 to disable the automatic circuit and close constant 4CR-2 thereby energizing solenoid 1SOV thus opening valve V1. When selector switch 2SS is closed in its automatic position, relay 5CR is closed opening relay contact 5CR-1 to disable the manual circuit, and to close relay contact 5CR-2 thereby energizing solenoid 1SOV only when the computer output contact 0o is closed thereby opening pneumatic valve V1 for the time periods specified in FIGS. 22A and 22B and in the sequence of operation determined by the programed computer 300.

Since all valves V1–V19 are operated by circuits identical to those described above for valve V1, these circuits will not be described in detail but are illustrated in FIGS. 23A–23D. The computer outputs, switches and coils, and their functions are set forth in FIG. 24.

Since the timing and sequence of operational functions performed by the computer are standard functions performed by computers, it is believed to be unnecessary to describe the specific programming of the computer in detail.

From the foregoing description it will be apparent that the closed loop method and apparatus of the present invention discloses a process for processing articles, such as alodining aluminum articles. The apparatus includes supply and return piping with valved supply and valved return manifolds therein. The supply piping is independently connected by the valved supply manifold between a plurality of supply tanks and a processing tank; and the return piping is connected between the processing tank and independently, through the valved return manifold, to the supply tanks. The valves and two pumps are preferably computer controlled for first initiating major steps by circulating liquids from one supply tank at a time through the processing tank for treating the article and for return to the same supply tank. Most major steps are followed by air purging the supply and return lines for returning substantially all flowable liquid into the supply tank from which it originated thereby minimizing contamination of the other liquids. Other apparatus cleans the air of toxic fluids with the environmentally safe air being discharged to the atmosphere and with the toxic liquids separated therefrom being further separated into two groups for collection and reuse in the process.

Although the best mode contemplated for carrying out the present invention has been herein shown and described, it will be apparent that modification and variation may be made without departing from what is regarded to be the subject matter of the invention.

What is claimed is:

1. In a closed loop apparatus for processing an article, comprising:

means defining a plurality of liquid supply tanks each containing a supply of liquid different from that in the other supply tanks;

means defining a processing tank having the article to be processed therein;

means defining selectively operable valved supply piping having a plurality of branches connecting each of said supply tanks to said processing tank, means defining selectively operable valved return piping having a plurality of branches connecting said processing tank to selected ones of said supply tanks;

said return piping means including an upright return manifold having a convex bottom wall, a ported top wall communicating with a return pump and a plurality of valved return ports connected to an associated supply tank or to an associated drain sump, each return port having its lowermost surface positioned at an elevation which gravitationally receives and discharges all flowable liquid within said return manifold when said associated valved return port is open;

means for circulating one liquid chemical from one of said supply tanks through said supply piping into the processing tank for contacting the article therein for a predetermined interval of time and for returning the liquid to said one tank;

means for terminating the flow of said one liquid chemical from said one supply tank; and means for purging at least the return piping and return manifold of substantially all flowable liquid for minimizing contamination of said other liquids by cleansing the return piping and return manifold of substantially all of said one liquid and returning the purged liquid to said one supply tank.

2. An apparatus according to claim 1 wherein said circulating means includes a plurality of spray nozzles within said processing tank which are stationary when spraying said liquid chemical on the article.

3. An apparatus according to claim 1 and additionally comprising means for rotating said article about a horizontal axis while said one liquid chemical is circulated through said processing tank.

4. An apparatus according to claim 1 and additionally comprising means for isolating the supply piping from said one supply tank after completion of said predetermined time interval; said supply piping means including a cylindrical supply manifold having a concave ported bottom wall communicating with a supply pump, a ported top wall communicating with a supply of compressed air and a plurality of valved supply ports connected to associated ones of said supply tanks; and means for purging the supply piping of substantially all flowable liquid chemical by directing compressed air into and through the ported top wall of said supply manifold for returning substantially all of the liquid chemical to said one supply tank for minimizing contamination of the supply piping and other liquids with said one liquid chemical..

5. An apparatus according to claim 4 wherein the supply and return piping is purged by compressed air at about 85 pounds per square inch for an interval of about 1–3 minutes, and wherein said compressed air enters the top ported wall of said supply piping into said processing tank and then through an associated branch of said return piping into the ported top wall of said return manifold and through an associated branch of said return piping thereby returning the purged liquid to said one tank.

6. An apparatus according to claim 4 and additionally comprising means for rinsing the processing tank with water, and means for draining the processing tank and returning the rinse water to a second one of said supply tanks.

7. An apparatus according to claim 4 wherein the liquid chemical is heated above ambient temperature for optimum reaction with the article in the processing tank.

8. An apparatus according to claim 4 and additionally comprising a plurality of spray nozzles in said circulating means for spraying said liquids onto said articles, and means for rotating said article about a horizontal axis while said liquids are being sprayed onto the article.

9. A closed loop apparatus for processing an article, comprising:

means defining a plurality of liquid supply tanks each containing a supply of liquid different from that in the other supply tanks;

means defining a processing tank having the article to be processed therein;

means defining selectively operable valved supply piping connecting each of said supply tanks to said processing tank, means defining selectively operable valved return piping connecting said processing tank to each of said supply tanks;

means for circulating one liquid chemical from one of said supply tanks through said supply piping into the processing tank for contacting the article therein for a predetermined interval of time and for returning the liquid to said one tank;

means for terminating the flow of said one liquid chemical from said one supply tank;

means for purging at least the return piping of substantially all flowable liquid for minimizing contamination of said other liquids by cleansing the return piping of substantially all of said liquid and returning the purged liquid to said one supply tank;

means for isolating the supply piping from said one supply tank after completion of said predetermined time interval, and means for purging the supply piping of substantially all flowable liquid chemical by directing compressed air therethrough for returning substantially all of the liquid chemical to said one supply tank for minimizing contamination of the supply piping and other liquids with said one liquid chemical;

air purification means for drawing clean air downwardly toward said supply tanks and for removing toxic fluids from above said tanks; said air purification means comprising a conduit system for collecting the fumes from above said supply tanks, and scrubber means for separating the environmentally safe air from the toxic fluids and for separating the toxic fluids into at least two separating liquids having different chemical composition for collection at separate locations.

10. A closed loop apparatus for processing an article, comprising:

means defining a plurality of liquid supply tanks each holding a supply of liquid therein with certain tanks handling liquids which generate toxic fluids above the associated supply tanks;

means defining a processing tank having the article to be processed therein;

means defining supply piping connecting said supply tanks to said processing tank;

means defining return piping connecting said processing tank to said supply tank;

selectively operable valve means in said supply piping and in said return piping for controlling the flow of fluid to and from said processing tank;

a first power driven pump means in said supply piping;

a second power driven pump means in said return piping;

control means for selectively starting and stopping said pumps and for selectively opening and closing selected valve means in said supply and return piping for circulating a plurality of liquid chemicals one at a time from an associated supply tank through said supply conduit, through said processing tank, and for return to said associated supply tank for a predetermined interval of time, after each time interval said control means being effective to terminate the flow of liquid chemical and actuate certain valves for purging at least a portion of said piping with compressed air for returning substantially all of the chemical containing liquid into the tank from which it originated thereby conserving the chemical containing liquids and minimizing contamination of the liquid with each other; and air purification means comprising a conduit system for collecting the toxic fluids from above said supply tanks, and scrubber means for separating the environmentally safe air from the toxic fluids and for separating the toxic fluids into at least two separate liquids having different chemical compositions for collecting at separate locations.

11. An apparatus according to claim 10 and additionally comprising spray nozzles within said processing tank and communicating with said supply piping for spraying fluids onto said article.

12. An apparatus according to claim 11 wherein the closed loop apparatus is used for alodining aluminum; wherein said control means is responsive to progressively spray the article with an alkaline cleaning liquid, a hot water rinse, a deoxidizing liquid, a cold water rinse, a chromic conversion liquid, a hot water chromic rinse and an industrial water rinse, and wherein said control means is responsive to purge at least the return piping after each spraying of the article with one of said liquids.

13. A closed loop apparatus for processing an article, comprising:

means defining a processing tank with the article therein;

means defining a plurality of supply tanks each having a different processing liquid therein;

means defining selectively operable valved supply piping connecting said supply tanks to said processing tank, said supply piping including a multi-ported supply manifold with each supply tank being connected to said supply manifold through a valved conduit;

means defining selectively operable return piping connecting said processing tank to said supply tanks, said return piping including a multi-ported return manifold having upright tubular side walls with a plurality of side ports therein and with each supply tank being connected to said return manifold through a valved conduit that is connected to an associated side port, a convex bottom wall having a fluid wetted surface and a ported top wall, said convex bottom wall having said fluid wetted surface disposed at a higher elevation than the lowermost surface of said side ports, pump means in said piping for circulating liquids through said supply and return piping;

control means for selectively opening certain ones of said valves in said supply and return piping for first circulating one processing liquid from a selected one of said supply tanks against the article in said processing tank and for return to said selected supply tank for a predetermined period; and means responsive to said control means for directing compressed air through said supply and return piping for returning substantially all of said flowable liquid in said processing tank and in said supply and return piping to said selected supply tank for conserving said one processing liquid and minimizing contamination of the one liquid with other liquids.

14. A closed loop method of processing an article with a supply of at least one liquid chemical stored in an associated supply tank which flows through supply piping into a processing tank with the article therein and returns to the supply tank through return piping that includes a return manifold having a lower wall with a convex surface, comprising the steps of:

circulating one liquid chemical from said associated supply tank through supply piping into the processing tank for contacting the article therein for a predetermined interval of time;

terminating the flow of chemical from said one supply tank;

removing the chemical from the processing tank and returning the chemical to said one supply tank through the return piping;

isolating the return piping for purging;

purging the returned piping of substantially all flowable liquid for minimizing contamination of said return piping and other liquids with said one liquid chemical; and drawing fresh air downwardly toward the top of the supply tanks, drawing toxic fluid from above the supply tanks into a scrubber for making the air adjacent the supply tanks environmentally safe, separating the fluid into environmentally safe air for discharge into the atmosphere, and separating at least two toxic liquids from said toxic fluid with the liquids having different chemical compositions for collection at separate locations.

15. A method according to claim 14 wherein the purging step is conducted with compressed air which blows substantially all flowable liquid over a convex surface of the return manifold into and through the return piping to said one supply tank.

16. A method according to claim 14 wherein said circulating step includes circulating said liquid chemical from the associated supply tank, through the supply piping, through the processing tank, and through the return piping to the associated supply tank for said predetermined interval.

17. A method according to claim 16 and additionally comprising the steps of isolating the supply piping from said associated supply tank; and forcing compressed air through said supply piping, through the processing tank, and through the return piping to the associated supply tank for a predetermined interval for returning the liquid chemical into the associated supply tank.

18. A method according to claim 17 followed by the rinsing steps of: directing a rinse water through the supply piping, the processing tank, and the return piping; isolating the water supply from the supply piping; purging the supply piping, processing tank and the return piping with compressed air; draining the processing tank through the return piping; purging the returned piping with compressed air; and collecting the rinse water in a container.

19. A method according to claim 18 and including the steps of spraying the water onto the article in the tank, and rotating the article about a horizontal axis while being contacted by the water spray.

20. A method according to claim 14 wherein said liquid is circulated into the processing tank by pumping; wherein the article is maintained in contact with the chemical by spraying the chemical onto the article, and wherein the chemical is returned to said one supply tank by pumping.

21. A method according to claim 14 and additionally including the steps of isolating the supply piping for purging, and purging the supply piping of substantially all flowable liquid chemical for minimizing contamination of the supply piping and other liquids with said one liquid chemical.

22. A method according to claim 21 wherein the supply piping is purged by compressed air at about 85 pounds per square inch for an interval of about 1–3 minutes.

23. A method according to claim 22 and additionally comprising the steps of rinsing the processing tank with water, and draining the processing tank returning the rinse water to one of said supply tanks which contains water.

24. A method according to claim 14 wherein said liquid chemical is heated above ambient temperature for optimum reaction with the article.

25. A method according to claim 14 and additionally including the step of rotating the article within the processing tank about a horizontal axis when the liquid chemical is sprayed onto the article.

26. A closed loop apparatus for processing an article comprising:

means defining a plurality of liquid supply tanks each containing a supply of liquid different from that in the other supply tanks, some of said liquids generating toxic fluids which raise above the associated tanks;

means defining a processing tank having the article to be processed therein;

means defining selectively operable valved supply piping connecting each of said supply tanks to said processing tank;

means defining selectively operable valved return piping connecting said processing tank to each of said supply tanks;

means for circulating one liquid chemical from one of said supply tanks through said supply piping into the processing tank for contacting the article therein for a predetermined interval of time and for returning the liquid to said one tank;

means for terminating the flow of said one liquid chemical from said one supply tank;

means for purging at least the return piping of substantially all flowable liquid for minimizing contamination of said other liquids by cleansing the return piping of substantially all of said one liquid and returning the purged liquid to said one supply tank; and air purification means comprising a conduit system for collecting the toxic fluids from above said supply tanks, and scrubber means for separating the environmentally safe air from the toxic fluids and for separating the toxic fluids into at least two separate liquids having different chemical compositions for collection at separate locations.

* * * * *